US009381410B2

(12) United States Patent
Golden et al.

(10) Patent No.: US 9,381,410 B2
(45) Date of Patent: Jul. 5, 2016

(54) METAL WOOD CLUB

(71) Applicant: Acushnet Company, Fairhaven, MA (US)

(72) Inventors: Charles E Golden, Carlsbad, CA (US); Stephen S. Murphy, Carlsbad, CA (US); Mark C. Myrhum, Del Mar, CA (US); Darryl C. Galvan, El Cajon, CA (US); Thomas O. Bennett, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 163 days.

(21) Appl. No.: 14/271,580

(22) Filed: May 7, 2014

(65) Prior Publication Data

US 2015/0321055 A1 Nov. 12, 2015

(51) Int. Cl.

| | |
|---|---|
| ***A63B 53/04*** | (2015.01) |
| ***A63B 53/06*** | (2015.01) |
| ***A63B 59/00*** | (2015.01) |

(52) U.S. Cl.

CPC ..... *A63B 53/06* (2013.01); *A63B 53/0466* (2013.01); *A63B 59/0074* (2013.01); *A63B 2053/0433* (2013.01); *A63B 2053/0491* (2013.01)

(58) Field of Classification Search

CPC ..... A63B 53/06; A63B 59/0074; A63B 2053/0433; A63B 2053/0491; A63B 53/0466

USPC ..... 473/334–339

See application file for complete search history.

(56) References Cited

U.S. PATENT DOCUMENTS

| | | | |
|---|---|---|---|
| 1,091,231 | A | 3/1914 | Millar |
| 1,096,359 | A | 5/1914 | Dwight |
| 1,133,129 | A | 3/1915 | Govan |
| 1,167,106 | A | 1/1916 | Palmer |
| 1,167,387 | A | 1/1916 | Daniel |
| 1,322,182 | A | 11/1919 | Duncan |
| 1,396,470 | A | 11/1921 | Taylor |
| 1,436,579 | A | 11/1922 | Dayton |
| 1,467,435 | A | 9/1923 | Kinnear |
| 1,534,600 | A | 4/1925 | Mattern |
| 1,575,364 | A | 3/1926 | Hodgkins |
| 1,840,924 | A | 1/1932 | Tucker |

(Continued)

FOREIGN PATENT DOCUMENTS

| | | | |
|---|---|---|---|
| GB | 2133295 | A | 7/1984 |
| JP | 10137374 | A | 5/1998 |

(Continued)

*Primary Examiner* — Sebastiano Passaniti

(74) *Attorney, Agent, or Firm* — Kevin N. McCoy

(57) ABSTRACT

A weight system configured to adjust the location of the center of gravity of a golf club head comprising an adjustable weight comprising an aperture dimensioned to receive a fastener, a threaded bore formed in said sole and configured to receive a fastener, and a fastener configured to pass through the aperture of the adjustable weight and engage the threaded bore, wherein rotation of said fastener in a first direction locks said adjustable weight into a locked position, preventing said adjustable weight from rotating relative to said body, and wherein rotation of said fastener in a second direction, opposite said first direction, unlocks said adjustable weight into an unlocked position and allows said adjustable weight to rotate about said fastener, and wherein said adjustable weight can be unlocked and rotated without completely removing said fastener from said threaded bore.

8 Claims, 15 Drawing Sheets

(56) References Cited

U.S. PATENT DOCUMENTS

| | | | |
|---|---|---|---|
| 2,041,676 | A | 5/1936 | Gallagher |
| 2,214,356 | A | 9/1940 | Wettlaufer |
| 2,517,245 | A | 8/1950 | Scott |
| 2,750,194 | A | 6/1956 | Clark |
| 3,064,980 | A | 11/1962 | Steiner |
| 3,212,783 | A | 10/1965 | Bradley et al. |
| 3,220,733 | A | 11/1965 | Saleeby |
| 3,466,047 | A | 9/1969 | Rodia et al. |
| 3,556,533 | A | 1/1971 | Hollis |
| 3,606,327 | A | 9/1971 | Gorman |
| 3,652,094 | A | 3/1972 | Glover |
| 3,692,306 | A | 9/1972 | Glover |
| 3,794,328 | A | 2/1974 | Gordon |
| 3,897,066 | A | 7/1975 | Belmont |
| 3,979,123 | A | 9/1976 | Belmont |
| 4,043,563 | A | 8/1977 | Churchward |
| 4,052,075 | A | 10/1977 | Daly |
| 4,085,934 | A | 4/1978 | Churchward |
| 4,195,842 | A | 4/1980 | Coleman |
| 4,340,230 | A | 7/1982 | Churchward |
| 4,423,874 | A | 1/1984 | Stuff, Jr. |
| 4,512,583 | A | 4/1985 | Vilmorin |
| 4,602,787 | A | 7/1986 | Sugioka et al. |
| D285,473 | S | 9/1986 | Flood |
| 4,732,389 | A | 3/1988 | Kobayashi |
| 4,754,977 | A | 7/1988 | Sahm |
| 4,795,159 | A | 1/1989 | Nagamoto |
| 4,811,949 | A | 3/1989 | Kobayashi |
| 4,867,458 | A | 9/1989 | Sumikawa et al. |
| 4,869,507 | A | 9/1989 | Sahm |
| 4,944,515 | A | 7/1990 | Shearer |
| 5,028,049 | A | 7/1991 | McKeighen |
| 5,042,806 | A | 8/1991 | Helmstetter |
| 5,050,879 | A | 9/1991 | Sun et al. |
| 5,154,424 | A | 10/1992 | Lo |
| 5,176,383 | A | 1/1993 | Duclos |
| 5,230,509 | A | 7/1993 | Chavez |
| D344,118 | S | 2/1994 | Lin |
| 5,297,794 | A | 3/1994 | Lu |
| 5,316,305 | A | 5/1994 | McCabe |
| 5,447,309 | A | 9/1995 | Vincent |
| 5,484,155 | A | 1/1996 | Yamawaki et al. |
| 5,518,243 | A | 5/1996 | Redman |
| 5,547,427 | A | 8/1996 | Rigal et al. |
| 5,570,886 | A | 11/1996 | Rigal et al. |
| 5,586,948 | A | 12/1996 | Mick |
| 5,720,674 | A | 2/1998 | Galy |
| 5,795,245 | A | 8/1998 | Chang et al. |
| 5,797,807 | A | 8/1998 | Moore |
| 5,803,830 | A | 9/1998 | Austin et al. |
| 5,888,148 | A | 3/1999 | Allen |
| 5,916,042 | A | 6/1999 | Reimers |
| 5,935,019 | A | 8/1999 | Yamamoto |
| 5,947,840 | A | 9/1999 | Ryan |
| 5,967,905 | A | 10/1999 | Nakahara et al. |
| 5,989,134 | A | 11/1999 | Antonious |
| 6,056,649 | A | 5/2000 | Imai |
| 6,074,310 | A | 6/2000 | Ota |
| 6,089,994 | A | 7/2000 | Sun |
| 6,120,389 | A | 9/2000 | Kruse |
| 6,123,627 | A | 9/2000 | Antonious |
| D433,073 | S | 10/2000 | Sodano |
| 6,162,132 | A | 12/2000 | Yoneyama |
| 6,217,461 | B1 | 4/2001 | Galy |
| 6,348,014 | B1 | 2/2002 | Chiu |
| 6,379,265 | B1 | 4/2002 | Hirakawa et al. |
| 6,409,612 | B1 | 6/2002 | Evans et al. |
| 6,458,044 | B1 | 10/2002 | Vincent et al. |
| 6,471,601 | B1 | 10/2002 | McCabe et al. |
| D465,251 | S | 11/2002 | Wood et al. |
| 6,524,194 | B2 | 2/2003 | McCabe |
| D482,421 | S | 11/2003 | Kessler |
| 6,645,085 | B2 | 11/2003 | McCabe et al. |
| 6,648,772 | B2 | 11/2003 | Vincent et al. |
| 6,648,773 | B1 | 11/2003 | Evans |
| 6,773,360 | B2 | 8/2004 | Willett et al. |
| 6,811,496 | B2 | 11/2004 | Wahl et al. |
| D501,235 | S | 1/2005 | Imamoto |
| 6,860,818 | B2 | 3/2005 | Mahaffey et al. |
| 6,881,158 | B2 | 4/2005 | Yang et al. |
| D514,184 | S | 1/2006 | Kawami |
| 6,988,960 | B2 | 1/2006 | Mahaffey et al. |
| D519,178 | S | 4/2006 | Shimazaki |
| D527,434 | S | 8/2006 | Foster et al. |
| 7,121,956 | B2 | 10/2006 | Lo |
| 7,140,977 | B2 | 11/2006 | Atkins, Sr. |
| 7,153,220 | B2 | 12/2006 | Lo |
| 7,166,038 | B2 | 1/2007 | Williams et al. |
| 7,166,040 | B2 | 1/2007 | Hoffman et al. |
| 7,166,041 | B2 | 1/2007 | Evans |
| 7,186,190 | B1 | 3/2007 | Beach et al. |
| 7,189,169 | B2 | 3/2007 | Billings |
| 7,223,180 | B2 | 5/2007 | Willett et al. |
| 7,294,064 | B2 | 11/2007 | Tsurumaki et al. |
| 7,294,065 | B2 | 11/2007 | Liang et al. |
| 7,326,472 | B2 | 2/2008 | Shimazaki et al. |
| 7,407,447 | B2 | 8/2008 | Beach et al. |
| 7,410,425 | B2 | 8/2008 | Willett et al. |
| 7,410,426 | B2 | 8/2008 | Willett et al. |
| 7,419,441 | B2 | 9/2008 | Hoffman et al. |
| 7,448,963 | B2 | 11/2008 | Beach et al. |
| 7,452,285 | B2 | 11/2008 | Chao et al. |
| 7,578,753 | B2 | 8/2009 | Beach et al. |
| 7,604,548 | B2 | 10/2009 | Cole |
| 7,670,235 | B2 | 3/2010 | Lo |
| 7,717,804 | B2 | 5/2010 | Beach et al. |
| 7,758,452 | B2 | 7/2010 | Soracco |
| 7,771,290 | B2 | 8/2010 | Bezilla et al. |
| 7,775,905 | B2 | 8/2010 | Beach et al. |
| 7,824,277 | B2 | 11/2010 | Bennett et al. |
| 8,043,167 | B2 | 10/2011 | Boyd et al. |
| 8,425,348 | B2 * | 4/2013 | Boyd ..... A63B 53/0466 473/335 |
| 8,435,135 | B2 | 5/2013 | Stites et al. |
| 8,696,491 | B1 | 4/2014 | Myers |
| 8,790,195 | B1 * | 7/2014 | Myers ..... A63B 53/0466 473/335 |
| 9,205,311 | B2 * | 12/2015 | Stokke ..... A63B 53/06 |
| 2002/0137576 | A1 | 9/2002 | Dammen |
| 2002/0160851 | A1 | 10/2002 | Liao |
| 2003/0148818 | A1 | 8/2003 | Myrhum et al. |
| 2004/0192463 | A1 | 9/2004 | Tsurumaki et al. |
| 2005/0009622 | A1 | 1/2005 | Antonious |
| 2005/0096151 | A1 | 5/2005 | Hou et al. |
| 2006/0052181 | A1 | 3/2006 | Serrano et al. |
| 2006/0058112 | A1 | 3/2006 | Haralason et al. |
| 2006/0100029 | A1 | 5/2006 | Lo |
| 2006/0122004 | A1 | 6/2006 | Chen et al. |
| 2006/0217216 | A1 | 9/2006 | Iizuka |
| 2007/0155533 | A1 | 7/2007 | Solheim et al. |
| 2007/0155534 | A1 | 7/2007 | Tsai et al. |
| 2008/0132353 | A1 | 6/2008 | Hsiao |
| 2009/0118034 | A1 * | 5/2009 | Yokota ..... A63B 53/0466 473/338 |
| 2010/0331103 | A1 * | 12/2010 | Takahashi ..... A63B 53/0466 473/338 |
| 2013/0090185 | A1 | 4/2013 | Boyd et al. |
| 2014/0038746 | A1 | 2/2014 | Beach et al. |

FOREIGN PATENT DOCUMENTS

| | | | |
|---|---|---|---|
| JP | 10234902 | A | 9/1998 |
| JP | 10248964 | A | 9/1998 |
| JP | 11319167 | A | 11/1999 |
| JP | 2000176059 | A | 6/2000 |
| JP | 2001000606 | A | 1/2001 |
| JP | 2001149514 | A | 6/2001 |
| JP | 2002011124 | A | 1/2002 |
| JP | 2005160947 | A | 6/2005 |

(56) References Cited

FOREIGN PATENT DOCUMENTS

| | | | |
|---|---|---|---|
| JP | 2006000435 | A | 1/2006 |
| JP | 2006081862 | A | 3/2006 |
| JP | 2006122334 | A | 5/2006 |
| JP | 2006187489 | A | 7/2006 |
| JP | 2006198251 | A | 8/2006 |
| JP | 2006239154 | A | 9/2006 |

* cited by examiner

METAL WOOD CLUB

TECHNICAL FIELD

This present technology generally relates to systems, devices, and methods related to golf clubs, and more specifically to a wood-type golf club head with improved physical attributes.

DESCRIPTION OF THE RELATED TECHNOLOGY

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention relates primarily to hollow golf club heads, such as wood-type and utility-type (generally referred to herein as wood-type golf clubs).

Wood-type or metal-type golf club heads generally include a front or striking face, a crown, a sole, and an arcuate skirt including a heel, a toe and a back. The crown and skirt are sometimes referred to as a shell. The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club is particularly important to the golf shot because it contacts and interacts with the ground during the swing.

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design and manufacture of wood-type club heads requires careful attention to club head construction. Among the many factors that must be considered are material selection, material treatment, structural integrity and overall geometrical design. Exemplary geometrical design considerations include loft, lie, face angle, horizontal face bulge, vertical face roll, face size, center of gravity, sole curvature, and overall head weight. The interior design of the club head may be tailored to achieve particular characteristics, such as by including hosel or shaft attachment means, perimeter weighting on the face or body of the club head, and fillers within hollow club heads. Club heads are typically formed from stainless steel, aluminum, or titanium and are cast, stamped, as by forming sheet metal with pressure, forged, or formed by a combination of any two or more of these processes.

The club heads may be formed from multiple pieces that are welded or otherwise joined together to form a hollow head, as is often the case of club heads designed with inserts, such as soleplates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face and hosel. As technology progressed, it became more desirable to increase the performance of the face of the club, usually by using a titanium material.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Known methods to enhance the weight distribution of wood-type club heads to help keep the club face square through impact as well as optimize gear effect spin and momentum transfer to the golf ball usually include the addition of weights to the body casting itself or strategically adding a weight element at some point in the club. Many efforts have been made to incorporate weight elements into the wood-type club head. These weight elements are usually placed at specific locations, which can have a positive influence on the flight of the ball as well as overcome a particular golfer's swing shortcomings.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that position of weight elements in existing golf club head designs are not easily adjustable. Thus, there exists a need for an improved golf club head. The present technology is directed to a golf club head incorporating a position adjustable weight system. The position adjustable weight system provides the ability to fine tune the performance characteristics of the golf club via manipulation of the position of an adjustable weight, thereby manipulating the location of the center of gravity and the moment of inertia of the golf club to suit the golfer's preference and increase the club's playability.

One non-limiting embodiment of the present technology includes a golf club head, comprising a body having a face, a sole, a crown, and a skirt joining said face, sole, and crown, the body having a center of gravity; wherein said body comprises a coordinate system with an x-axis located horizontal to said face, a y-axis located vertical to said face, and a z-axis located through said face; and a weight system configured to adjust the location of said center of gravity of said body; wherein said weight system comprises: an adjustable weight comprising an aperture, said aperture dimensioned to receive a fastener; a threaded bore formed in said sole, said threaded bore configured to receive a fastener; and a fastener configured to pass through said aperture of said adjustable weight and engage said threaded bore, wherein rotation of said fastener in a first direction locks said adjustable weight into a locked position, preventing said adjustable weight from rotating relative to said body; wherein rotation of said fastener in a second direction, opposite said first direction, unlocks said adjustable weight into an unlocked position and allows said adjustable weight to rotate about said fastener, wherein said adjustable weight can be unlocked and rotated without completely removing said fastener from said threaded bore; wherein rotation of said adjustable weight alters said location of said center of gravity of said body.

In an additional non-limiting embodiment of the present technology said adjustable weight comprises a first engaging arm and a second engaging arm, each engaging arm comprising a proximal portion and a distal portion, said proximal portions adjacent said aperture, said engaging arms extending outwards from said aperture substantially along said sole of said body, terminating at said distal portions of said engaging arms.

In an additional non-limiting embodiment of the present technology said first engaging arm comprises a first weight portion and said second engaging arm comprises a second weight portion, wherein said first weight portion comprises a different mass than said second weight portion.

In an additional non-limiting embodiment of the present technology said first weight portion is affixed to said distal portion of said first engaging arm and said second weight portion is affixed to said distal portion of said second engaging arm.

In an additional non-limiting embodiment of the present technology said sole of said golf club head comprises a first engagement member and a second engagement member, said first and second engagement members adapted to engage any one of said engaging arms when said adjustable weight is in said locked position, said first and second engagement members preventing said adjustable weight from rotating relative to said body.

In an additional non-limiting embodiment of the present technology said first and second engagement members comprise recesses formed in said sole of said body dimensioned to receive said distal portions of said engaging arms.

In an additional non-limiting embodiment of the present technology said first and second engagement members each comprise a sole surface, at least two side surfaces substantially perpendicular to said sole surface, and an encapsulating surface substantially parallel to and opposite the sole surface, wherein said at least two side surfaces prevent said adjustable weight from rotating relative to said body when said adjustable weight is in said locked position and wherein said encapsulating surface is configured to prevent at least a portion of said distal ends of said engagement arms from engaging the ground as said golf club head is swung.

In an additional non-limiting embodiment of the present technology said rotation of said fastener in said first direction forces said proximal portions of said engaging arms to move towards said sole, said engaging arms to deflect, and said distal portions of said engaging arms to extend outwards away from said fastener, substantially parallel to said sole of said body, and, provided said engaging arms are aligned with said engagement members, said rotation of said fastener in said first direction forces said distal portions of said engaging arms to protrude into said recesses of said engagement members, and wherein said rotation of said fastener in said second direction allows said proximal portions of said engaging arms to extend away from said sole and said distal portions of said adjustable weight to retract inwards towards said fastener, substantially parallel to said sole of said body, disengaging said engaging arms from said engagement members.

In an additional non-limiting embodiment of the present technology said fastener includes a retaining member configured to prevent said fastener from disengaging said internally threaded bore.

In an additional non-limiting embodiment of the present technology said adjustable weight comprises a third engaging arm, a third weight portion, and a third engagement member.

An additional non-limiting embodiment of the present technology includes a method of adjusting the center of gravity of a golf club head comprising rotating a fastener located on the sole of the body of said golf club head in a second direction unlocking an adjustable weight, wherein said fastener engages an internally threaded bore formed in said sole and rotating said fastener in said second direction does not include removing said fastener from said internally threaded bore; rotating said adjustable weight relative to said body to move the center of gravity of said golf club head; and rotating said fastener in a first direction, opposite said second direction, locking said adjustable weight relative to said body.

In an additional non-limiting embodiment of the present technology rotation of said fastener in said first direction pulls said adjustable weight towards said sole and forces at least one engaging arm of said adjustable weight to extend substantially along said sole away from said fastener and to engage an engagement member located on said sole, wherein said engagement member prevents said adjustable weight from rotating relative to said body.

An additional non-limiting embodiment of the present technology includes a golf club head comprising: a body having a face, a sole, a crown, and a skirt joining said face, sole, and crown, the body having a center of gravity; wherein said body comprises a coordinate system with an x-axis located horizontal to said face, a y-axis located vertical to said face, and a z-axis located through said face; and a weight system configured to adjust the location of said center of gravity of said body; wherein said weight system comprises: an adjustable weight; and a fastener configured to engage said adjustable weight, wherein rotation of said fastener in a first direction locks said adjustable weight in a locked position; wherein rotation of said fastener in a second direction, opposite said first direction, unlocks said adjustable weight into an unlocked position and allows said adjustable weight to be moved, wherein said adjustable weight can be unlocked and moved without removing said fastener; wherein movement of said adjustable weight alters said location of said center of gravity of said body.

An additional non-limiting embodiment of the present technology includes a channel formed therein said sole of said body, wherein said channel is dimensioned to slideably receive said adjustable weight.

In an additional non-limiting embodiment of the present technology said adjustable weight comprises a first member and a second member, said first member comprising a first weight body, said first weight body of said first member comprising a bore formed therein to receive a fastener, said second member comprising a second weight body, said second weight body of said second member comprising an internally threaded bore to engage said fastener, wherein rotation of said fastener in a first direction forces said first member closer to said second member and wherein rotation of said fastener in a second direction, opposite said first direction, allows said first member to extend away from said second member.

In an additional non-limiting embodiment of the present technology said channel comprises a first wall and a second wall substantially parallel to said first wall, wherein said first weight body of said first member is adjacent said first wall and said second weight body of said second member is adjacent said second wall, wherein said first member comprises at least two engaging arms extending away from said first weight body of said first member and towards said second wall and wherein said second member comprises at least two engaging arms extending away from said second weight body of said second member and towards said first wall.

In an additional non-limiting embodiment of the present technology when said fastener is rotated in a first direction, said engaging arms of said first member are configured to contact said second wall and deflect and said engaging arms of said second member are configured to contact said first wall and deflect.

In an additional non-limiting embodiment of the present technology said engaging arms engaging said first and second walls prevent said adjustable weight from sliding along said channel when said adjustable weight is in a locked position.

In an additional non-limiting embodiment of the present technology at least one of said engaging arms includes at least one protrusion and wherein at least one of said first and second walls include a corresponding recess configured to receive said at least one protrusion, wherein said at least one protrusion and at least one recess are configured to prevent said adjustable weight from sliding along said channel when said adjustable weight is in a locked position.

In an additional non-limiting embodiment of the present technology said first wall and said second wall are substantially perpendicular to said y axis, wherein said first wall comprises an access port to access said adjustable weight.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1A:
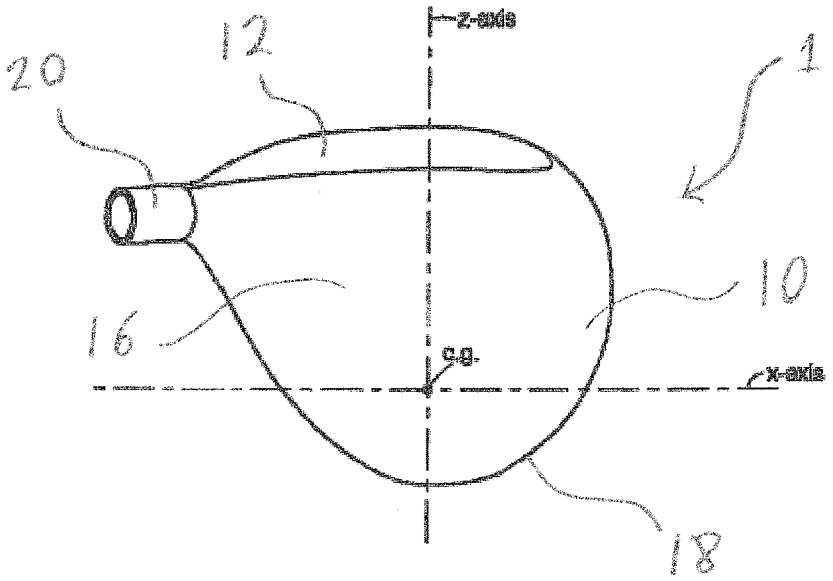
FIG. 1A illustrates a top view of one embodiment of a golf club head including a center of gravity.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to golf clubs. More specifically, some embodiments relate to a golf club head incorporating an adjustable weight system.

Figure 1B:
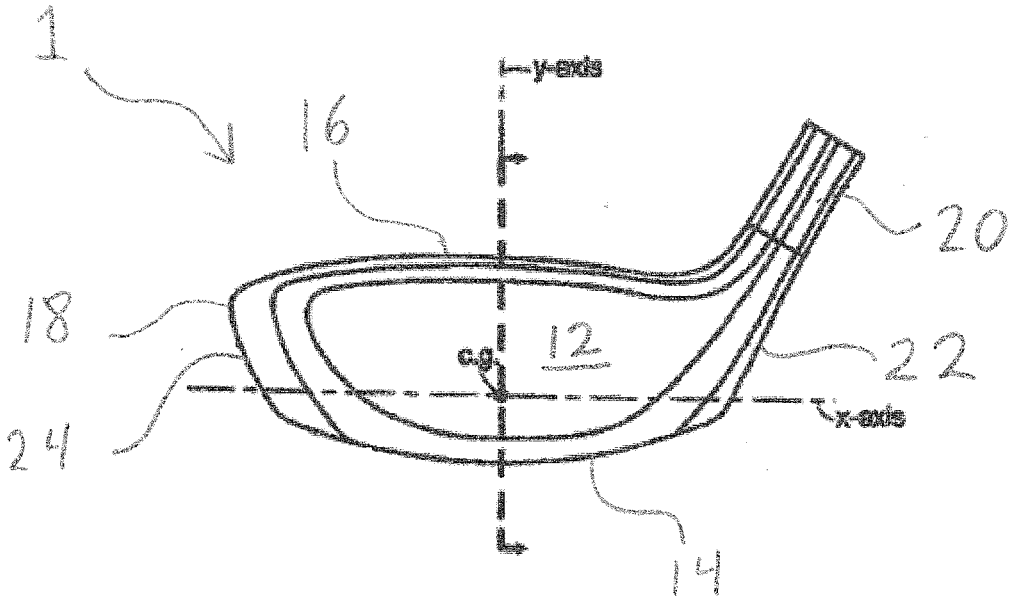
FIG. 1B illustrates a front view of the golf club head of FIG. 1A.
Figure 1C:
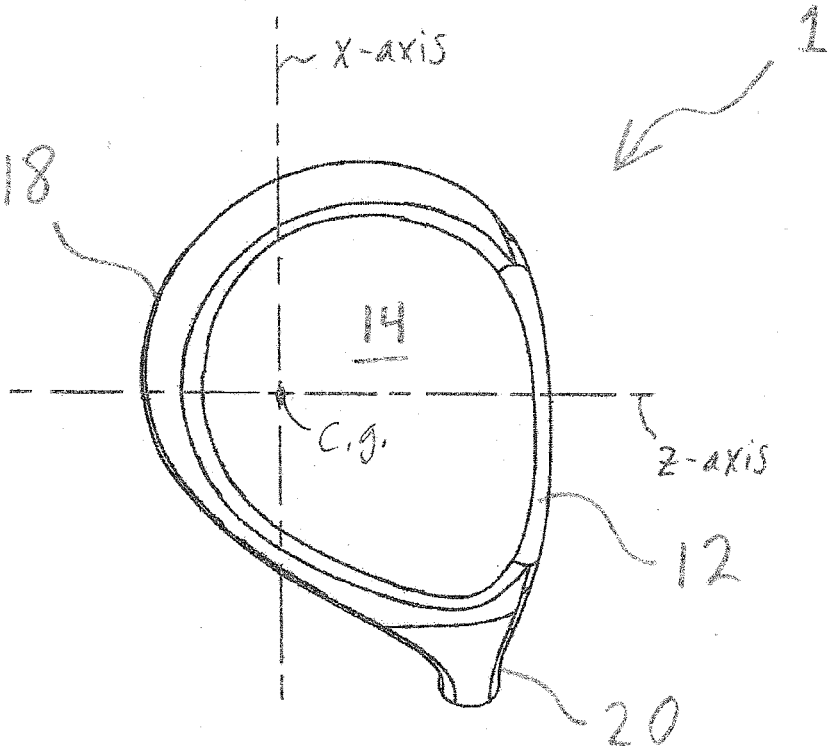
FIG. 1C illustrates a bottom view of the golf club head of FIG. 1A.

FIG. 1A illustrates a top view of one embodiment of a golf club head 1 including a center of gravity. FIG. 1B illustrates a front view of the golf club head 1 of FIG. 1A. FIG. 1C illustrates a bottom view of the golf club head 1 of FIG. 1A. The club head 1 includes a body 10 having a striking face 12, a sole 14, a crown 16, a skirt 18, and a hosel 20. The body 10 defines a hollow interior volume 30. The face can be provided with grooves or score lines of varying design. The club head 1 has a heel 22 and a toe 24. FIGS. 1A-C illustrate the center of gravity (c.g.) of the golf club head 1. In order to improve the playability and performance of the golf club head 1 it is desired to be able to move the c.g. within the club head 1 to a more optimal position. Preferably, the club head 1 features a weight system, which may include for example the weight systems illustrated in FIGS. 2-16, to move the c.g. within the club head 1 to the desired position. In addition to moving the c.g. location, many of the embodiments described herein can also manipulate the moment of inertia of the club head 1.

As illustrated in FIGS. 1A-1C, the body 10 can include a coordinate system with an x-axis located horizontal to the striking face 12, a y-axis located vertical to the striking face 12, and a z-axis located through the striking face 12. In some embodiments, the c.g. may be moved substantially along the x-axis. In some embodiments, the c.g. may be moved substantially along the z-axis. In some embodiments, the c.g. may be moved along both the x-axis and z-axis. In some embodiments, the c.g. may also be moved along the y-axis.

Figure 2A:
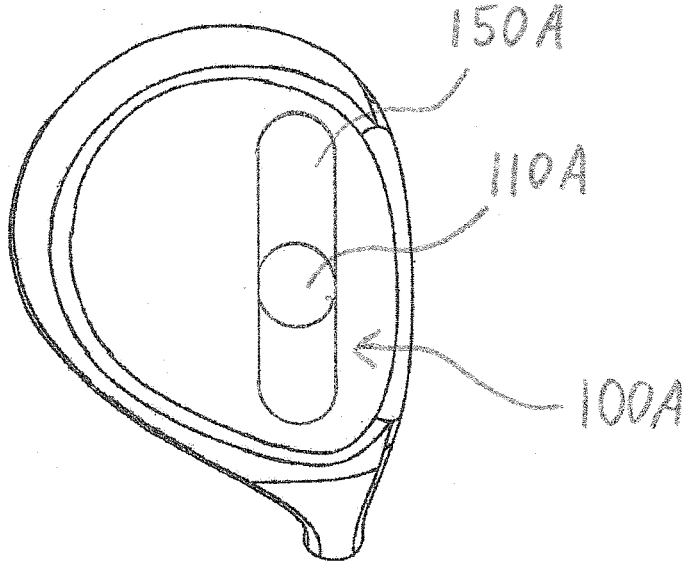
FIG. 2A illustrates a bottom view of one embodiment of a golf club head including a weight system configured to adjust the center of gravity of along the x-axis.

FIG. 2A illustrates a bottom view of one embodiment of a golf club head 1 including a weight system 100A configured to adjust the center of gravity of the body of the golf club head along the x-axis. The weight system 100A can be incorporated into the body 10 of a golf club head 1. As illustrated in FIGS. 2A-D, the weight system 100A can be incorporated into the sole 14 of the body 10. The weight system 100A can include an adjustable weight 110A, which can be selectively moved to manipulate the location of the c.g. of the golf club head 1. The sole 14 of the body 10 can include a weight channel 150A dimensioned to slideably receive the adjustable weight 110A. In some embodiments, as illustrated in FIG. 2A, the adjustable weight 110A can be moved along the x-axis, allowing the c.g. of the golf club head 1 to manipulate the c.g. location along the x-axis. Once the adjustable weight 110A has been moved to the desired location, the adjustable weight 110A can be locked in place so that it does not move relative to the body 10 and the c.g. location remains constant while the golf club is utilized to strike a golf ball.

Figure 2B:
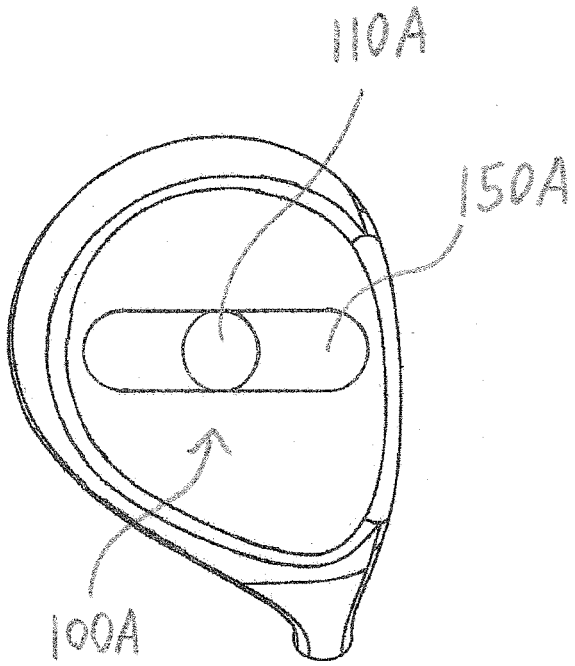
FIG. 2B illustrates a bottom view of one embodiment of a golf club head including a weight system configured to adjust the center of gravity of along the z-axis.
Figure 2C:
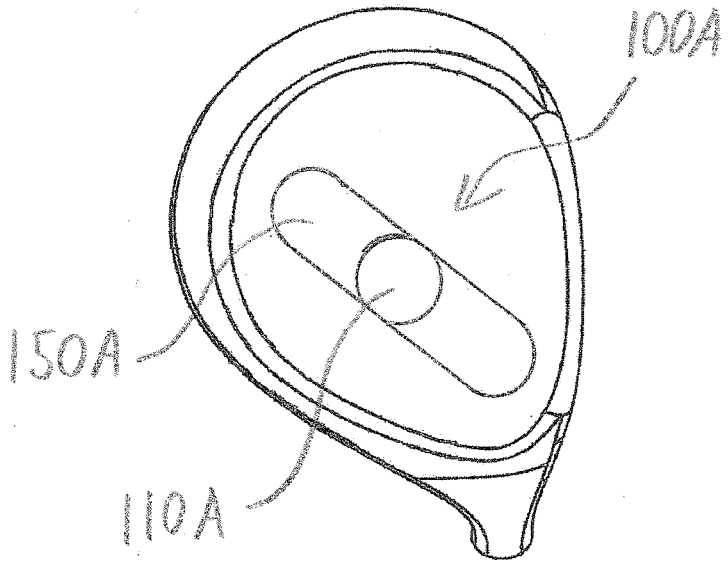
FIG. 2C illustrates a bottom view of one embodiment of a golf club head including a weight system configured to adjust the center of gravity of along both the x-axis and z-axis.
Figure 2D:
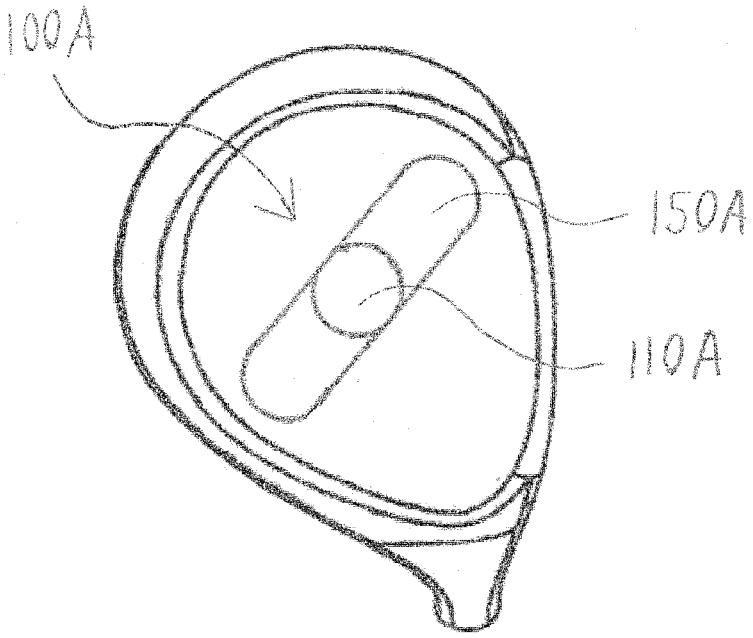
FIG. 2D illustrates a bottom view of one embodiment of a golf club head including a weight system configured to adjust the center of gravity of along both the x-axis and z-axis.

In other embodiments, the weight system 100A can allow adjustment of the c.g. location along the z-axis or y-axis, either independently or in addition to adjustment along the x-axis. In some embodiments, the adjustable weight 110A can be moved along the z-axis. FIG. 2B illustrates a bottom view of one embodiment of a golf club head 1 including a weight system 100A configured to adjust the center of gravity along the z-axis. In some embodiments, the adjustable weight 110A can be moved along both the x-axis and the z-axis. FIG. 2C-D illustrate bottom views of embodiments of a golf club head 1 including a weight system 100A configured to adjust the center of gravity along both the x-axis and z-axis. In some embodiments, as illustrated in FIG. 2C, the adjustable weight 110A can be slid at an angle to both the x-axis and z-axis such that in one direction the adjustable weight 110A slides rearward away from the striking face 12 and towards the toe 24 of the golf club head 1 and in the opposite direction the adjustable weight 110A slides forwards towards the striking face 12 and towards the heel 22 of the golf club head 1. In some embodiments, as illustrated in FIG. 2D, the adjustable weight 110A can be slid at an angle to both the x-axis and z-axis such that in one direction the adjustable weight 110A slides rearward away from the striking face 12 and towards the heel 22 of the golf club head 1 and in the opposite direction the weight slides forwards towards and striking face 12 and towards the toe 24 of the golf club head 1. Those skilled in the art will realize that the orientations and movement of the adjustable weight 110A illustrated in FIGS. 2A-2D and discussed above can apply to the other embodiments described herein.

Figure 3:
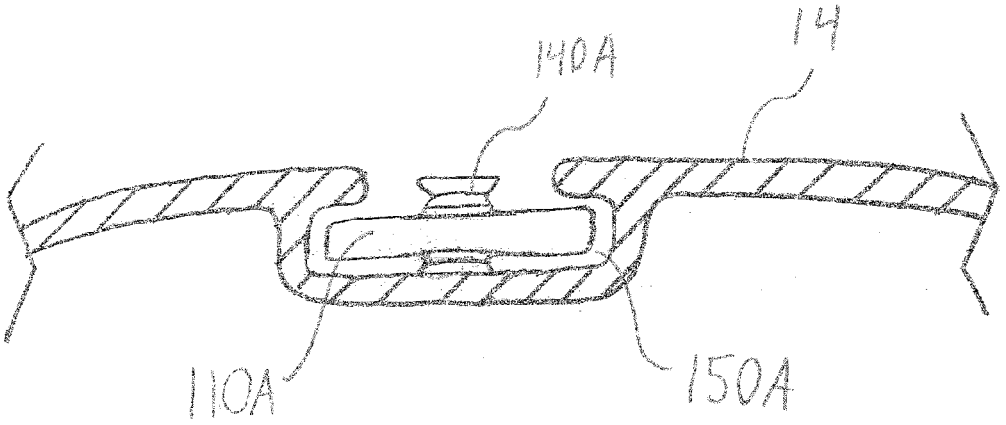
FIG. 3 illustrates a cross sectional view of one embodiment of the weight system of FIGS. 2A-D.

FIG. 3 illustrates a cross sectional view of one embodiment of the weight system 100A of FIGS. 2A-D. As described above, the sole 14 of the body 10 can include a weight channel 150A dimensioned to slideably receive the adjustable weight 110A. The weight system 100A can include a locking member configured to selectively lock the adjustable weight 110A in the desired location. The locking member can comprise a fastener 140A as illustrated in FIG. 3. The adjustable weight 110A can include a threaded bore 148A configured to accept and engage the fastener 140A. The fastener 140A can be rotated relative to the adjustable weight 110A to move between a locked and unlocked position. To lock the adjustable weight 110A, the fastener 140A can be rotated in a first direction relative to the adjustable weight 110A such that the fastener 140A contacts a portion of the weight channel 150A and forces the adjustable weight 110A towards the opposite side of the weight channel 150A. The friction between the adjustable weight 110A and fastener 140A and the weight channel 150A can limit movement of the adjustable weight 110A relative to the weight channel 150A. The adjustable weight 110A and/or weight channel 150A can include protrusions or a roughened surface to promote friction and further limit movement of the adjustable weight 110A relative to the weight channel 150A. To unlock the adjustable weight 110A, the fastener 140A can be rotated in a second direction, opposite the first direction, such that the adjustable weight 110A can slide relative to the weight channel 150A. In some embodiments, the adjustable weight 110A can be dimensioned to prevent rotation of the adjustable weight 110A relative to the weight channel 150A, such that the adjustable weight 110A does not rotate when the fastener 140A is rotated in a first or second direction. The adjustable weight 110A can include one or more flat surfaces configured to engage one or more walls of the weight channel 150A and prevent rotation of the adjustable weight 110A relative to the weight channel 150A.

Figure 4:
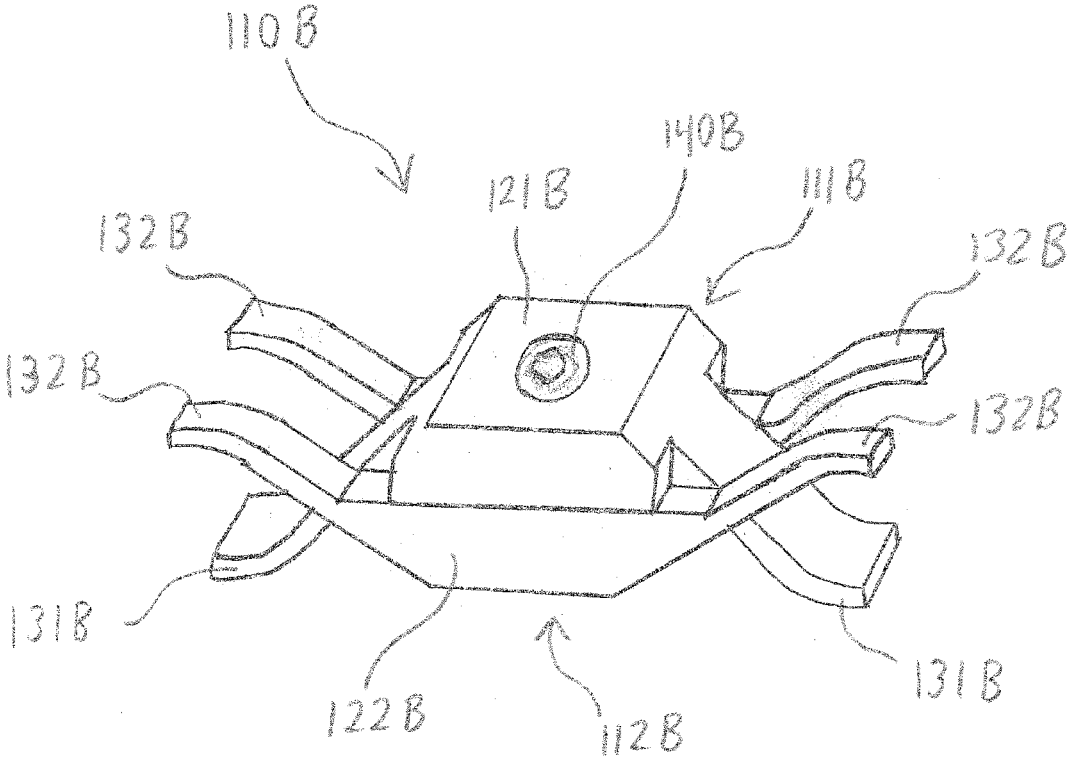
FIG. 4 illustrates a perspective view of one embodiment of a weight system.
Figure 5A:
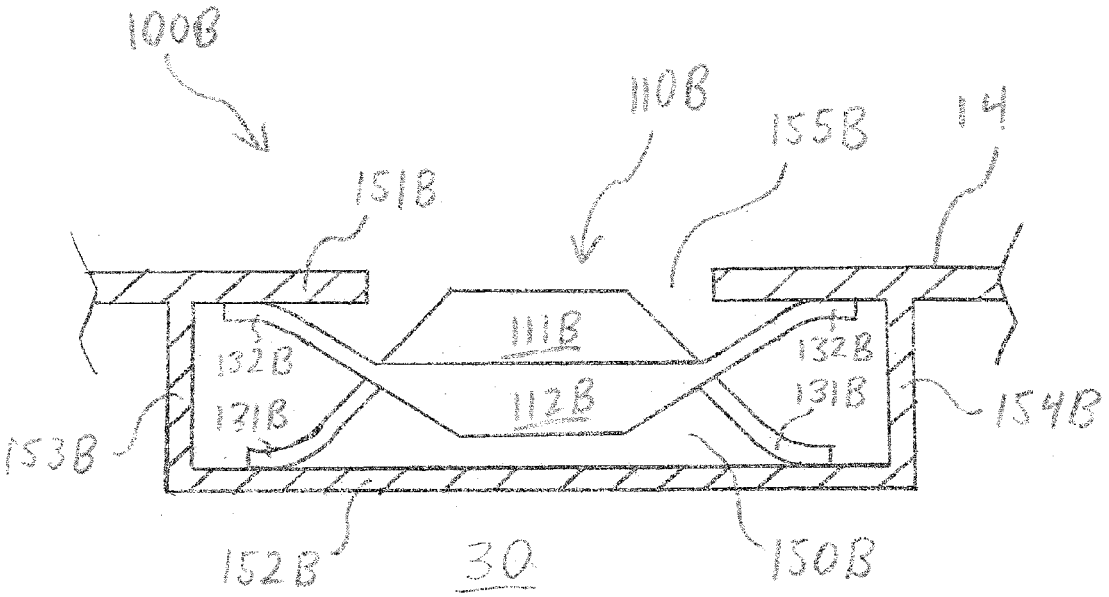
FIG. 5A illustrates a cross sectional view of the weight system of FIG. 4 within a channel and in a locked position.
Figure 5B:
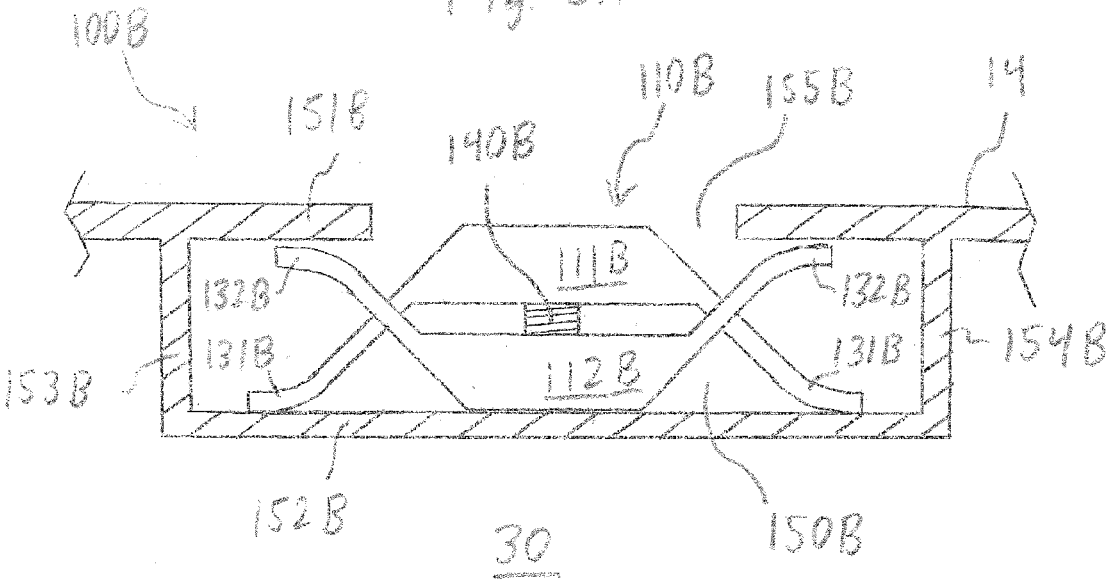
FIG. 5B illustrates a cross sectional view of the weight system of FIG. 4 within a channel and in an unlocked position.

FIG. 4 illustrates a perspective view of one embodiment of a weight system 100B. FIG. 5A illustrates a cross sectional view of the weight system 100B of FIG. 4 within a weight channel 150B and in a locked position. FIG. 5B illustrates a cross sectional view of the weight system 100B of FIG. 4 within a weight channel 150B and in an unlocked position. The weight system 100B can include an adjustable weight 110B comprising a plurality of members 111B, 112B. In some embodiments, as illustrated in FIGS. 4 and 5A-B, the adjustable weight 110B comprises a first member 111B and a second member 112B. The first member 111B can comprise a first weight body 121B. The first weight body 121B of the first member 111B can include a bore formed therein to receive a fastener 140B. The bore can be smooth to allow the fastener 140B to rotate without translating relative to the first member 111B. The second member 112B can include a second weight body 122B. The second weight body 122B of the second member 112B can include an internally threaded bore to engage the fastener 140B, wherein rotation of the fastener 140B in a first direction forces said first member 111B closer to the second member 112B. The first member 111B and second member 112B can be configured to abut one another when the adjustable weight 110B is in a locked position. Rotation of the fastener 140B in a second direction, opposite the first direction, can allow the first member 111B to extend away from said second member 112B.

As illustrated in FIGS. 5A-B, the adjustable weight 110B can be configured to slide within a weight channel 150B formed in the sole 14 of the body 10 of the golf club head 1. The weight channel 150B can comprise a first wall 151B and a second wall 152B substantially parallel to the first wall 151B. The first wall 151B can include an access port 155B along the length of the weight channel 150B providing access to the fastener 140B of the weight system 100B. The first weight body 121B of the first member 111B of the adjustable weight 110B can be located adjacent the first wall 151B and the second weight body 122B of the second member 112B can be located adjacent the second wall 152B. The first member 111B can include a plurality of engaging arms 131B extending away from the first weight body 121B of the first member 111B and towards the second wall 152B. In some embodiments, as illustrated in FIG. 4, the first member 111B can include two engaging arms 131B. In other embodiments, the first member 111B can include a different number of engaging arms 131B which may include for example, 3, 4, etc. The second member 112B can include a plurality of engaging arms 132B extending away from the second weight body 122B of the second member 112B and towards the first wall 151B. In some embodiments, as illustrated in FIG. 4, the second member 112B can include four engaging arms 132B. In other embodiments, the second member 112B can include a different number of engaging arms 132B which may include for example, 2, 3, etc.

As illustrated in FIG. 5A, when the fastener 140B is rotated in a first direction to lock the adjustable weight 110B, the engaging arms 131B of the first member 111B are configured to contact the second wall 152B and deflect as the fastener 140B is rotated and the engaging arms 132B of the second member 112B are configured to contact the first wall 151B and deflect as the fastener 140B is rotated. The interaction between the engaging arms 131B, 132B and the walls of the weight channel 150B can limit movement of the adjustable weight 110B along the weight channel 150B when the adjustable weight 110B is in a locked position. As illustrated in FIG. 5B, the fastener 140B can be rotated in a second direction, opposite the first direction, allowing the first member 111B to extend away from the second member 112B and unlocking the adjustable weight 110B. Unlocking the adjustable weight 110B reduces the friction between the engaging arms 131B, 132B and the walls of the weight channel 150, allowing the adjustable weight 110B to slide within the weight channel 150B. The weight channel 150B can include a third wall 153B and fourth wall 154B, the third and fourth wall 154B connecting the first wall 151B to the second wall 152B. The first member 111B and/or second member 112B can be configured to slideably engage the third and fourth wall 153B, 154B, preventing the adjustable weight 110B from rotating relative to the weight channel 150B.

Figure 6A:
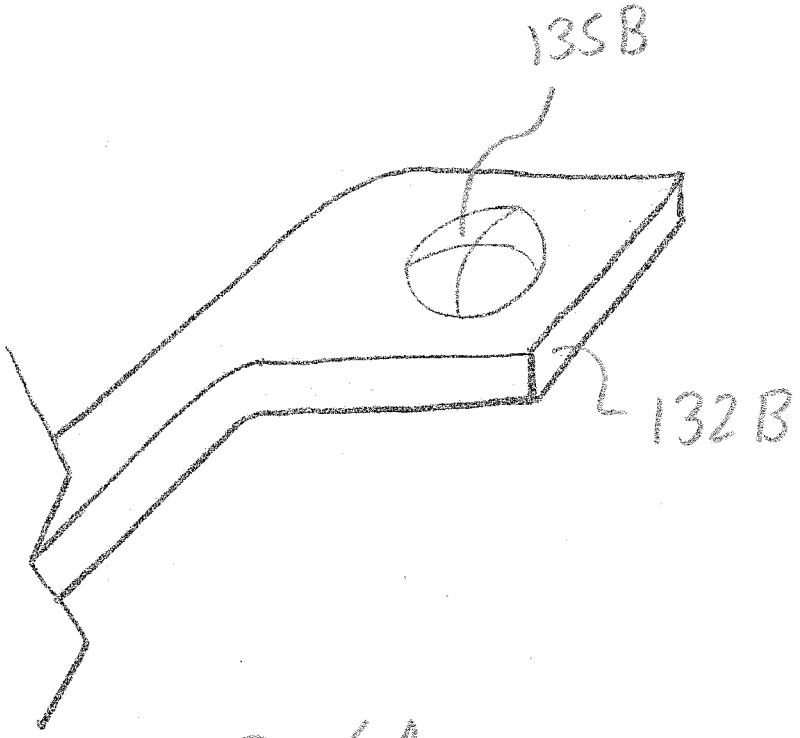
FIG. 6A illustrates a perspective view of one embodiment of an engaging arm of the weight system of FIG. 4.
Figure 6B:
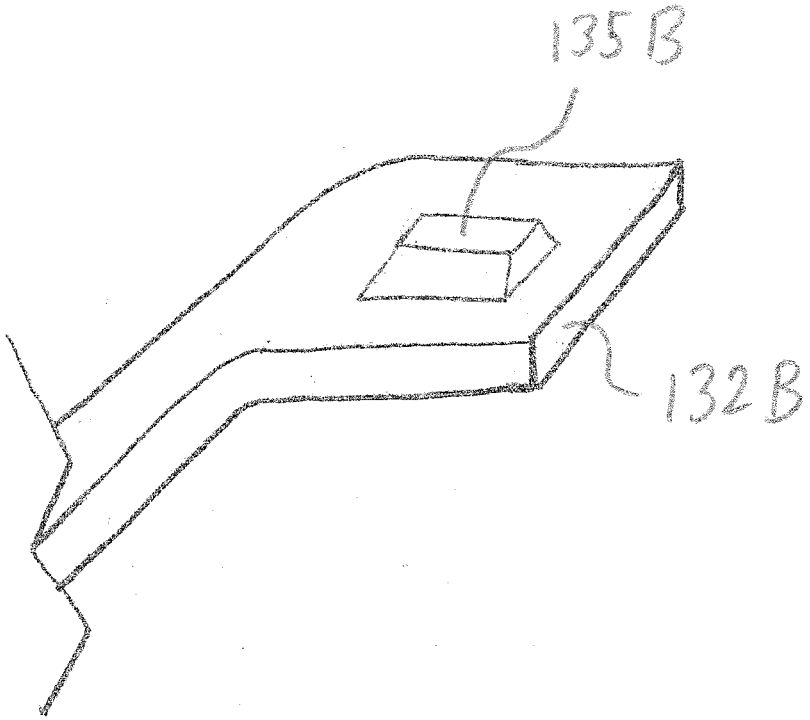
FIG. 6B illustrates a perspective view of an additional embodiment of an engaging arm of the weight system of FIG. 4.

FIG. 6A-B illustrate perspective views of embodiments of engaging arms 132B of the weight system 100B of FIG. 4. In some embodiments, at least one of the engaging arms 131B, 132B can include at least one protrusion 135B and at least one of the first and second walls 151B, 152B can include a complimentary recess dimensioned to receive the at least one protrusion 135B. The at least one protrusion 135B and at least one recess can limit the adjustable weight 110B from sliding along the weight channel 150B when the adjustable weight 110B is in a locked position. The protrusion 135B can be partially sphere shaped as illustrated in FIG. 6A. The protrusion 135B can be trapezoidal shaped as illustrated in FIG. 6B. In other embodiments the protrusion 135B can include a different shape. In some embodiments, an engaging arm 131B, 132B can include a plurality of protrusions 135B. In some embodiments, an engaging arm 131B, 132B and/or weight channel wall 151B, 152B can include a roughened surface to promote friction between the engaging arms 131B, 132B and the weight channel 150B. The embodiments described in FIGS. 4-6 can be oriented to slide the adjustable weight 110B along a variety of axes, which may include for example, the x-axis, the z-axis, the y-axis, or a combination which may include for example both the z-axis and x-axis.

Figure 7:
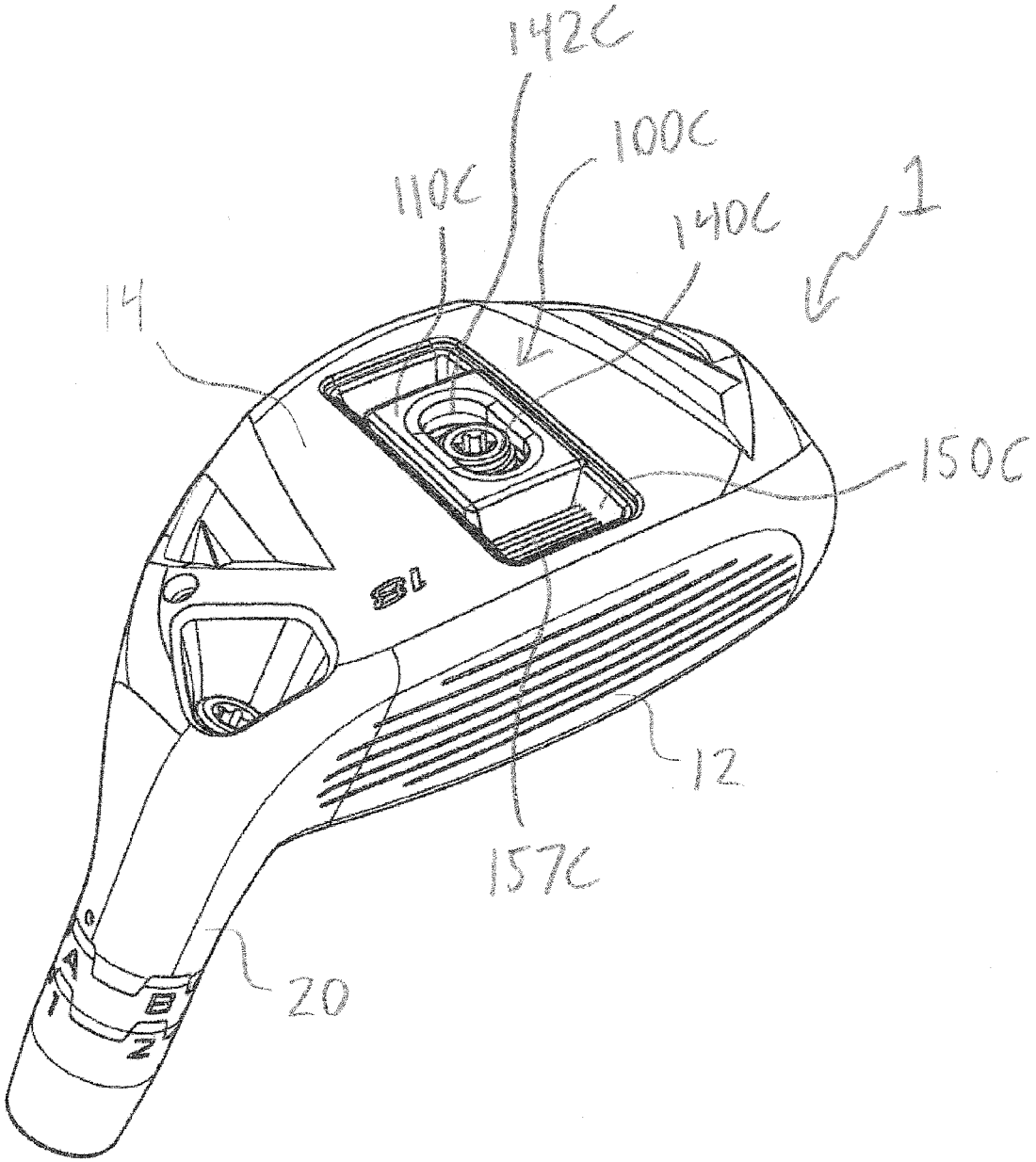
FIG. 7 illustrates a perspective view of one embodiment of a golf club head including a weight system configured to adjust the center of gravity along the z-axis.
Figure 8A:
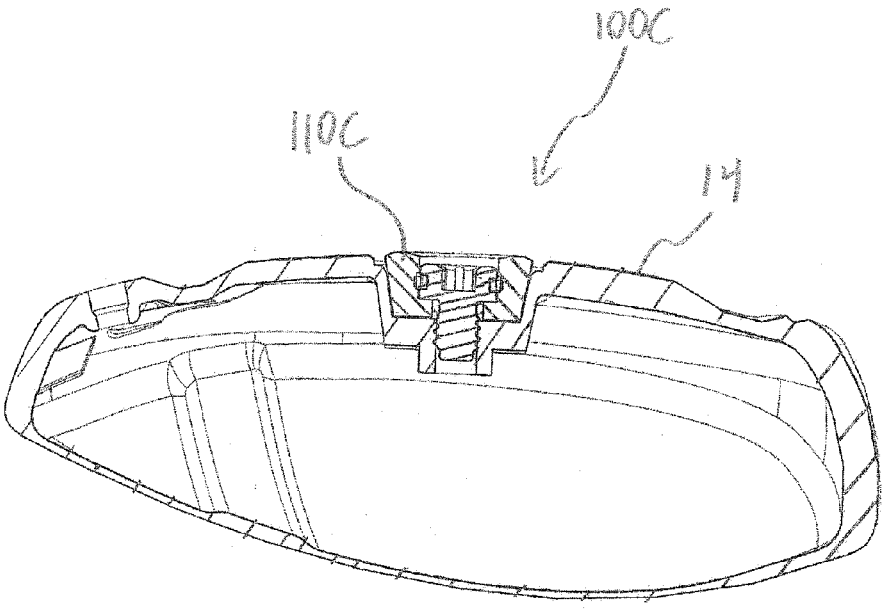
FIG. 8A illustrates a cross sectional view of the golf club head of FIG. 7.
Figure 8B:
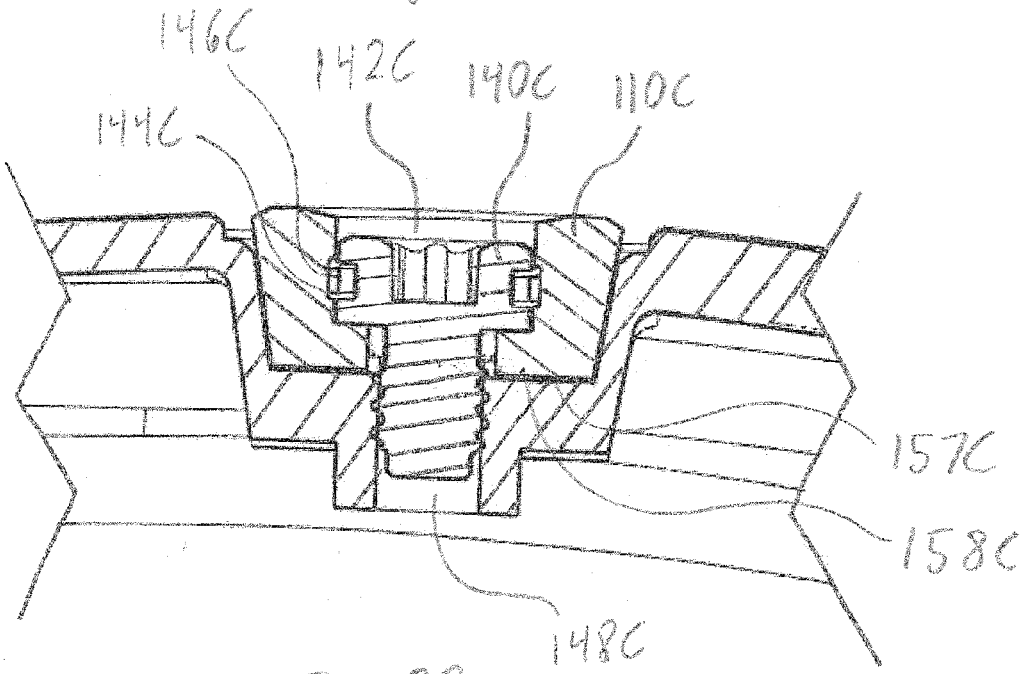
FIG. 8B illustrates a cross sectional detail view of the weight system of FIG. 8A.

FIG. 7 illustrates a perspective view of one embodiment of a golf club head 1 including a weight system 100C configured to adjust the center of gravity along the z-axis. FIG. 8A illustrates a cross sectional view of the golf club head 1 of FIG. 7. FIG. 8B illustrates a cross sectional detail view of the weight system 100C of FIG. 8A. The weight system 100C can include a weight channel 150C formed in the sole 14 of a golf club head 1 configured to receive an adjustable weight 110C. The weight system 100C can also include an adjustable weight 110C configured to selectively slide within the weight channel 150C. The weight system 100C can also include a fastener 140C configured to limit movement of the adjustable weight 110C when in a locked position. The weight system 100C can include a threaded bore 148C formed in the sole 14 of the golf club head 1 configured to receive and engage the fastener 140C. The threaded bore 148C can be located in a wall of the weight channel 150C.

The adjustable weight 110C can include a fastener channel 142C formed therein to slideably receive the fastener 140C. The fastener channel 142C can include a first portion dimensioned to receive the threaded shaft of the fastener 140C and a second portion dimensioned to receive the head of the fastener 140C. In some embodiments, the fastener 140C and adjustable weight 110C can include retention means to retain the adjustable weight 110C to the fastener 140C. The fastener channel 142C can include a snap ring groove 144C to slideably receive a portion of a snap ring 146C. The head of the fastener 140C can include a snap ring groove 144C to retain a snap ring 146C. The weight system 100C can include a snap ring 146C engaging the snap ring grooves 144C of the adjustable weight 110C and fastener 140C such that when the fastener 140C translates towards or away from the golf club head 1 due to rotation of the fastener 140C, the adjustable weight 110C translates along with the fastener 140C. In addition, the retention means can prevent the fastener 140C from being separated from the weight and reduce the risk of losing a portion of the adjustable weight system 100C.

The fastener 140C can be rotated in a first direction to lock the adjustable weight 110C relative to the weight channel 150C and can be rotated in a second direction, opposite the first direction, to unlock the adjustable weight 110C relative to the weight channel 150C and allow the adjustable weight 110C to slide within the weight channel 150C. The adjustable weight 110C can include an engaging surface 158C and the weight channel 150C can include an engagement surface 157C. When the fastener 140C is rotated in a first direction, the adjustable weight 110C is forced towards the engagement surface 157C of the weight channel 150C and friction between the engaging surface 158C of the adjustable weight 110C and the engagement surface 157C of the weight channel 150C can limit movement of the adjustable weight 110C relative to the weight channel 150C. In some embodiments, the engaging and engagement surfaces 158C, 157C can include roughened surfaces to promote friction between the two surfaces and further limit movement between the adjustable weight 110C and the weight channel 150C. As illustrated in FIG. 7, the engagement surface 157C can include a pattern of protrusions which may comprise ridges, to engage the engaging surface 158C of the adjustable weight 110C. The engaging surface 158C can include complimentary protrusions to the engagement surface 157C. When the fastener 140C is rotated in a second direction, the engaging surface 158C of the adjustable weight 110C is forced away from engagement surface 157C of the weight channel 150C and the adjustable weight 110C can be slid relative to both the fastener 140C and the weight channel 150C, with the fastener 140C sliding within the fastener channel 142C of the adjustable weight 110C. When the fastener 140C is rotated in a first direction, the engaging surface 158C of the adjustable weight 110C is forced towards the engagement surface 157C of the weight channel 150C, limiting movement of the adjustable weight 110C relative to the weight channel 150C. In other embodiments, the embodiment illustrated in FIGS. 7, 8A, and 8B can be adapted to adjust the center of gravity along other axes which may include for example, the x-axis, the z-axis, the y-axis, or a combination which may include for example both the z-axis and x-axis. In another embodiment, the adjustable weight 110C can have a first side which is heavier than a second side, allowing the adjustable weight 110C to be rotated to further manipulate the c.g. location of the golf club head 1. In one embodiment, the fastener 140C and adjustable weight 110C can be removed, rotated, and reinstalled such that the first side and second side have swapped places, manipulating the cg of the club head 1 even further than achievable just by sliding the adjustable weight 110C along the weight channel 150C. In another embodiment, the fastener 140C can be of sufficient length such that it can be rotated in a second direction until the adjustable weight 110C clears the weight channel 150C, and the adjustable weight 110C can be rotated without removing the fastener 140C from the threaded bore 148C.

Figure 9:
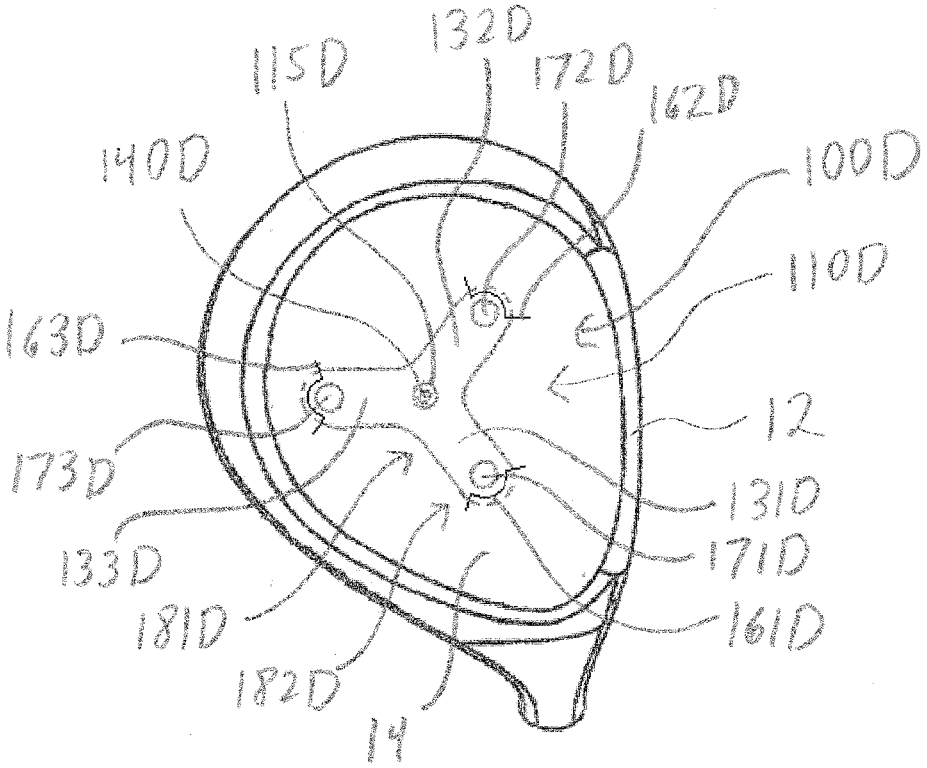
FIG. 9 illustrates a bottom view of one embodiment of a golf club head including a weight system configured to adjust the center of gravity along the x-axis and z-axis.

FIG. 9 illustrates a bottom view of one embodiment of a golf club head 1 including a weight system 100D configured to adjust the center of gravity along the x-axis and z-axis. The weight system 100D can include an adjustable weight 110D configured to rotate. The adjustable weight 110D can include an aperture 115D configured to receive a fastener 140D. The aperture 115D can be centrally located in the adjustable weight 110D. The adjustable weight 110D can be configured to abut the sole 14 of a golf club head 1. The sole 14 of the golf club head 1 can include a threaded bore 148D configured to receive and engage a fastener 140D. The weight system 100D can include a fastener 140D passing through the aperture 115D of the adjustable weight 110D and engaging the threads of the threaded bore 148D. Rotating of the fastener 140D in a first direction can lock the adjustable weight 110D into a locked position, preventing the adjustable weight 110D from rotating relative to the body 10 of the golf club head 1. Rotation of the fastener 140D in a second direction, opposite the first direction, can unlock the adjustable weight 110D into an unlocked position and allow the adjustable weight 110D to rotate about the fastener 140D. Rotation of the adjustable weight 110D can alter the c.g. location of the body 10 of the golf club head 1.

In some embodiments, the adjustable weight 110D can include a plurality of engaging arms 131D, 132D, 133D. As illustrated in FIG. 9, the adjustable weight 110D can include three engaging arms 131D, 132D, 133D. In other embodiments, including the embodiments illustrated in FIGS. 13A-

B, the adjustable weight 110 can include two engaging arms 131E, 132E. Additional embodiments can include a single engaging arm or more than three engaging arms. Each engaging arm 131D, 132D, 133D can comprise a proximal portion 181D and a distal portion 182D. The proximal portion 181D of each engaging arm 131D, 132D, 133D being adjacent the aperture 115D formed in the adjustable weight 110D. Each engaging arm 131D, 132D, 133D can extend outwards from the aperture 115D substantially along the sole 14 of the body 10, terminating at the distal portion 182D of each engaging arm 131D, 132D, 133D. In some embodiments, each engaging arm 131D, 132D, 133D can be substantially the same length from aperture 115D to distal portion 182D.

Each engaging arm 131D, 132D, 133D can include a weight portion 171D, 172D, 173D. The weight portion 171D, 172D, 173D can be located at the distal portion 182D of each engaging arm 131D, 132D, 133D, as illustrated in FIG. 9. The weight portion 171D, 172D, 173D of each engaging arm 131D, 132D, 133D can differ in mass such that rotation of the adjustable weight 110D alters the location of the c.g. of the body 10 of the golf club head 1. The weight portions 171D, 172D, 173D can comprise a mass between about 1 gram and 30 grams. The weight portions 171D, 172D, 173D can comprise a material denser than the rest of the adjustable weight 110D. In some embodiments, the weight portions 171D, 172D, 173D can be permanently affixed to the adjustable weight 110D. In other embodiments, the weight portions 171D, 172D, 173D can be interchangeable. In some embodiments, the adjustable weight 110D may be interchangeable to change the weight of the golf club head 1 or alter that weight distribution provided by the adjustable weight 110D.

The adjustable weight 110D can comprise a material which may include, for example, composite, carbon fiber composite, carbon fiber reinforced plastic, thermoplastic, plastic, urethane, titanium, steel, aluminum, etc., and the weight portions 171D, 172D, 173D can comprise a metal material, which may include for example, stainless steel, aluminum, tungsten, etc. In some embodiments, the adjustable weight 110D can comprise a material with a Young's modulus between 1 and 300 GPa. In some embodiments, the adjustable weight 110D can comprise a material with a Young's modulus between 1 and 250 GPa. In some embodiments, the adjustable weight 110D can comprise a material with a Young's modulus between 1 and 200 GPa. In some embodiments, the adjustable weight 110D can comprise a material with a Young's modulus between 1 and 150 GPa. In some embodiments, the adjustable weight 110D can comprise a material with a Young's modulus between 1 and 100 GPa. In some embodiments, the adjustable weight 110D can comprise a material with a Young's modulus between 1 and 50 GPa. In some embodiments, the adjustable weight 110D can comprise a material with a Young's modulus between 1 and 25 GPa. In some embodiments, the adjustable weight 110D can comprise a material with a Young's modulus between 1 and 15 GPa. In some embodiments, the adjustable weight 110D can comprise a material with a Young's modulus between 1 and 10 GPa. In some embodiments, the adjustable weight 110D can comprise a material with a Young's modulus between 100 and 125 GPa. In some embodiments, the adjustable weight 110D can comprise a material with a Young's modulus between 100 and 300 GPa. In some embodiments, the adjustable weight 110D can comprise a material with a Young's modulus between 150 and 250 GPa.

Figure 10:
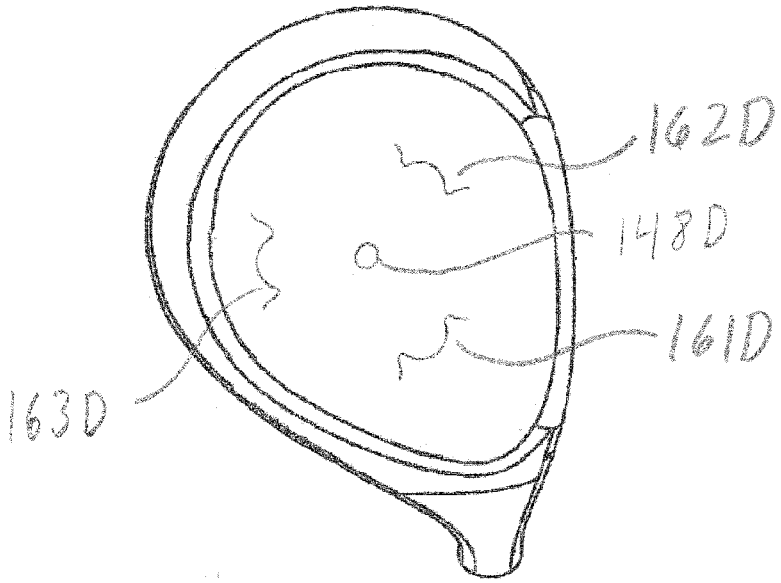
FIG. 10 illustrates a bottom view of one embodiment of a golf club head including a plurality of engagement members configured to engage the adjustable weight of the weight system of FIG. 9.
Figure 11A:
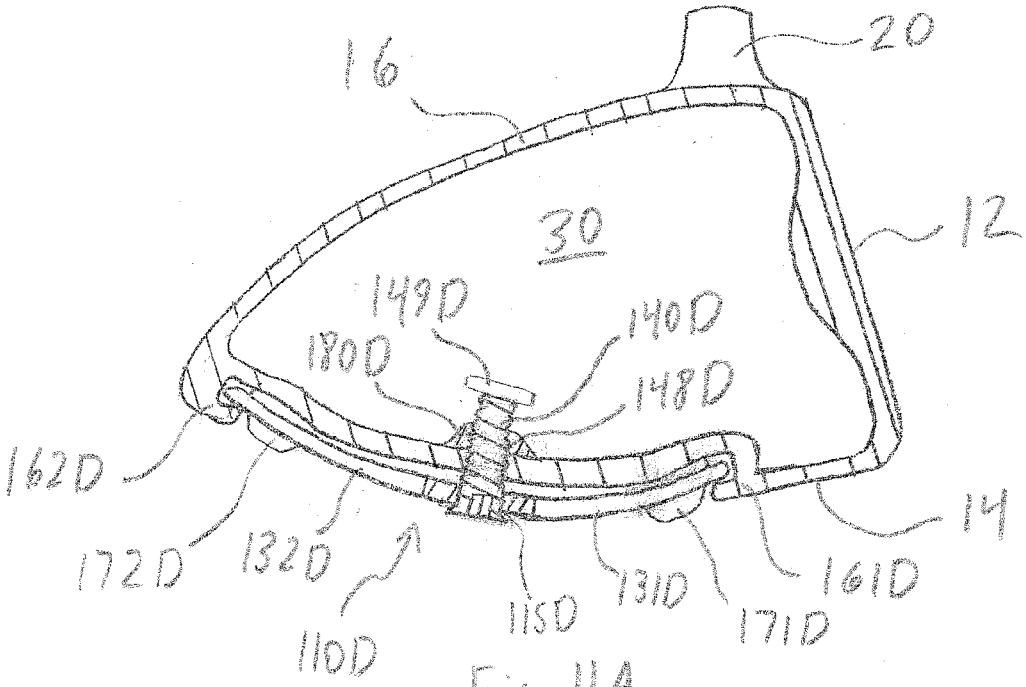
FIG. 11A illustrates a cross sectional view of one embodiment of a golf club head including a weight system configured to adjust the center of gravity along the x-axis and z-axis with the adjustable weight in a locked position.
Figure 11B:
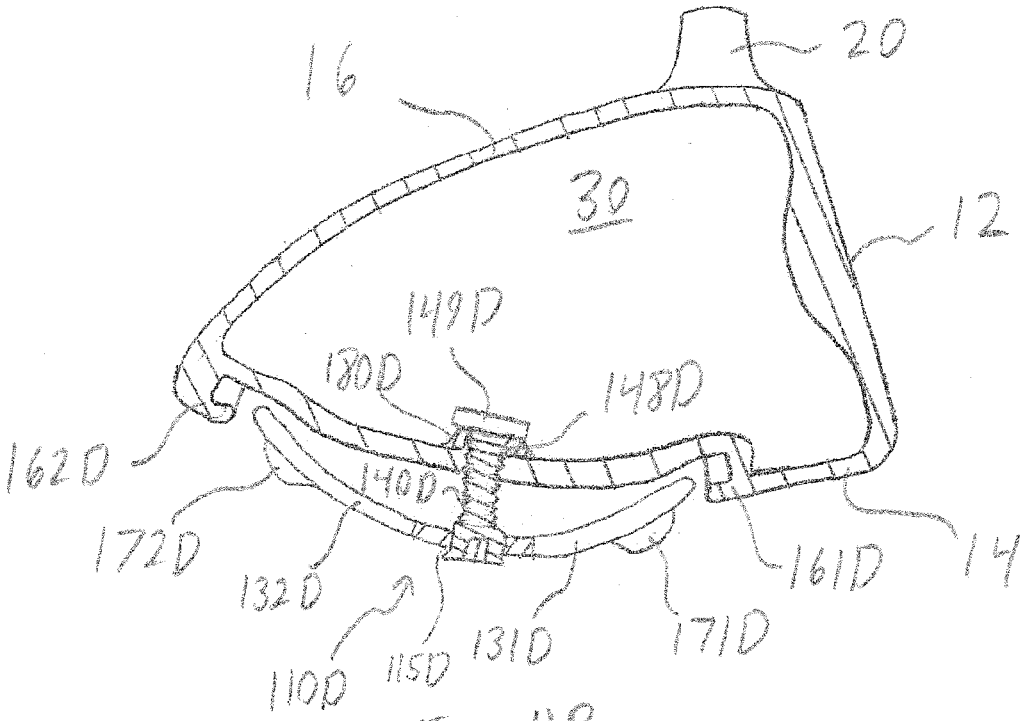
FIG. 11B illustrates a cross sectional view of one embodiment of a golf club head including a weight system configured to adjust the center of gravity along the x-axis and z-axis with the adjustable weight in an unlocked position.

FIG. 10 illustrates a bottom view of one embodiment of a golf club head 1 including a plurality of engagement members 161D, 162D, 163D configured to engage the adjustable weight 110D of the weight system 100D of FIG. 9. FIG. 11A illustrates a cross sectional view of one embodiment of a golf club head 1 including a weight system 100D configured to adjust the center of gravity along the x-axis and z-axis with the adjustable weight 110D in a locked position. FIG. 11B illustrates a cross sectional view of one embodiment of a golf club head 1 including a weight system 100D configured to adjust the center of gravity along the x-axis and z-axis with the adjustable weight 110D in an unlocked position. In some embodiments, the sole 14 of the golf club head 1 can include a plurality of engagement members 161D, 162D, 163D adapted to engage any one of the engaging arms 131D, 132D, 133D when the adjustable weight 110D is in a locked position. The engagement members 161D, 162D, 163D can prevent the adjustable weight 110D from rotating relative to the body 10 of the golf club head 1 when the adjustable weight 110D is in a locked position. As illustrated in FIGS. 11A and 11B, the engagement members 161D, 162D, 163D can comprise recesses formed in the sole 14 of the body 10 dimensioned to receive the distal portions 182D of the engaging arms 131D, 132D, 133D. The recesses can form a pocket, preventing the engagement members 161D, 162D, 163D from rotating once the adjustable weight 110D is in a locked position. The engagement members 161D, 162D, 163D can comprise a plurality of surfaces dimensioned to limit movement of each engaging arm 131D, 132D, 133D when the adjustable weight 110D is in a locked position. The engagement members 161D, 162D, 163D can comprise a sole surface preventing the engaging arms 131D, 132D, 133D from passing into the interior of the golf club head 1. The engagement members 161D, 162D, 163D can comprise at least one side surface preventing the engaging arms 131D, 132D, 133D from rotating relative to the golf club head 1. The engagement members 161D, 162D, 163D can comprise two side surfaces, one on each side of the engaging arms 131D, 132D, 133D, preventing the engagement arms 131D, 132D, 133D from rotating relative to the golf club head 1. The side surfaces can be substantially perpendicular to the sole surface. In some embodiments, the engagement members 161D, 162D, 163D can comprise three side surfaces, two preventing the engaging arms 131D, 132D, 133D from rotating relative to the golf club head 1, and a third surface preventing the end of the engaging arms from engaging the ground as the golf club is swung. In some embodiments, the engagement members 161D, 162D, 163D can comprise an encapsulating surface, substantially parallel to and opposite the sole surface, configured to prevent the end of the engagement arms 131D, 132D, 133D from engaging the ground as the golf club is swung.

As illustrated in FIGS. 11A and 11B, the adjustable weight 110D can be deformable. The adjustable weight 110D can have a convex or concave shape. Rotating the fastener 140D in a first direction can force the adjustable weight 110D from an unlocked position as illustrated in FIG. 11B to a locked position as illustrated in FIG. 11A, by forcing the proximal portions 181D of the engaging arms 131D, 132D, 133D to move towards the sole 14, causing the engaging arms 131D, 132D, 133D to deflect, and the distal portions 182D of the engaging arms 131D, 132D, 133D to extend outwards away from the fastener 140D, substantially parallel to the sole 14 of the body 10, and provided the engaging arms 131D, 132D, 133D are aligned with the engagement members 161D, 162D, 163D, the distal portions 182D of the engaging arms 131D, 132D, 133D can then protrude into the recesses of the engagement members 161D, 162D, 163D, preventing rotation of the adjustable weight 110D relative to the body 10 of the golf club head 1. Rotation of the fastener 140D in a second direction allows the proximal portions 181D of the engaging arms 131D, 132D, 133D to extend away from the sole 14 and the distal portions 182D of the adjustable weight 110D to retract inwards towards the fastener 140D, substantially parallel to the sole 14 of the body 10, disengaging the engaging arms 131D, 132D, 133D from the engagement members 161D, 162D, 163D. When in a locked position, due to the deflection of the adjustable weight 110D, the adjustable weight 110D can provide a force on the fastener 140D away from the sole 14 of the golf club head 1. The force provided by the adjustable weight can help prevent the fastener 140D from inadvertently loosening during use of the golf club, similar to a lock washer.

The number of engagement members can correspond to the number of engaging arms. In other embodiments, the engagement members can include slots, ports, hooks, craters, horseshoes, lips, or other features to receive the distal portions 182D of the engaging arms 131D, 132D, 133D and limit rotation of the adjustable weight 110 relative to the golf club head 1. The engagement members 161D, 162D, 163D can be configured to engage any portion of the engaging arms 131D, 132D, 133D, which does not necessarily need to be the distal portion 182D of the engaging arm 131D, 132D, 133D. In some embodiments, the engagement member 161D, 162D, 163D can comprise channels which receive at least a portion of the engaging arms 131D, 132D, 133D once the adjustable weight 110D is in a locked position.

Figure 12A:
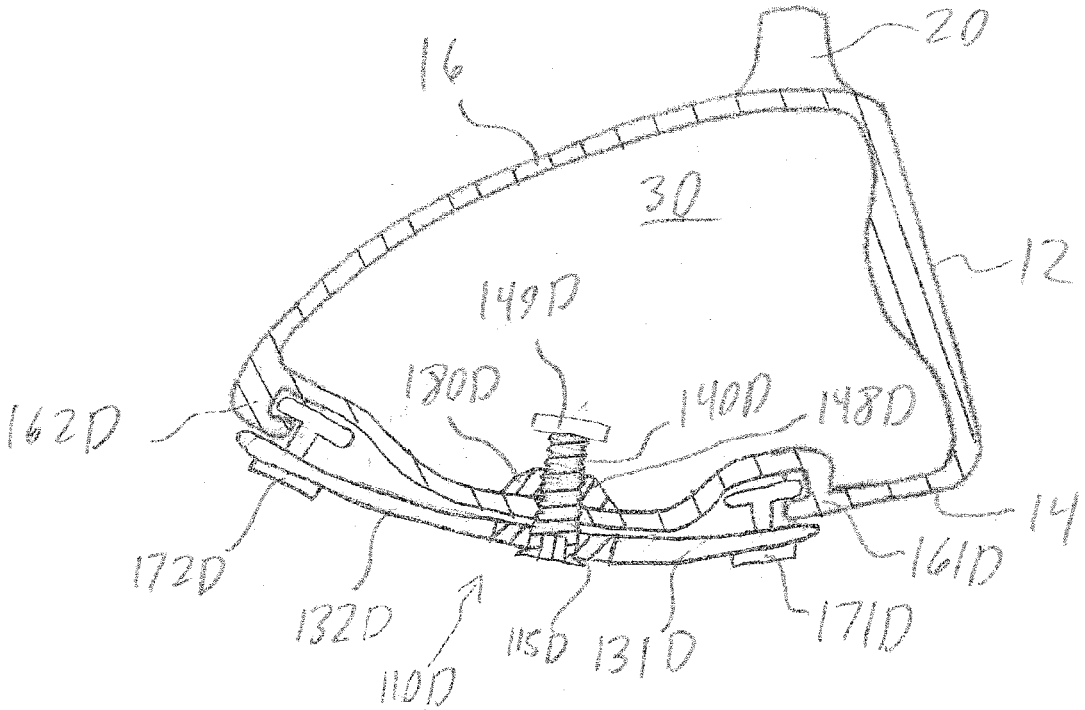
FIG. 12A illustrates a cross sectional view of an additional embodiment of a golf club head including a weight system configured to adjust the center of gravity along the x-axis and z-axis with the adjustable weight in a locked position.
Figure 12B:
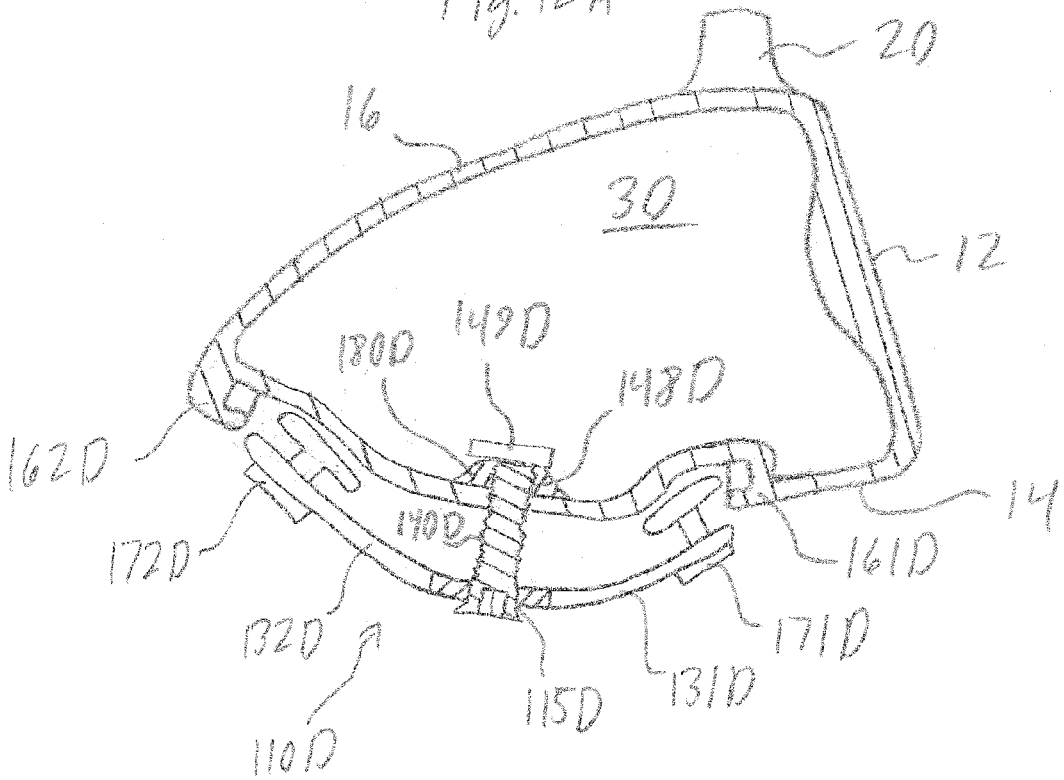
FIG. 12B illustrates a cross sectional view of an additional embodiment of a golf club head including a weight system configured to adjust the center of gravity along the x-axis and z-axis with the adjustable weight in an unlocked position.

As illustrated in FIGS. 12A and 12B, the engagement members 161D, 162D, 163D can be dimensioned to receive the weight portions 171D, 172D, 173D of the adjustable weight 110D. FIG. 12A illustrates a cross sectional view of an additional embodiment of a golf club head 1 including a weight system 100D configured to adjust the center of gravity along the x-axis and z-axis with the adjustable weight 110D in a locked position. FIG. 12B illustrates a cross sectional view of an additional embodiment of a golf club head 1 including a weight system 100D configured to adjust the center of gravity along the x-axis and z-axis with the adjustable weight 110D in an unlocked position.

In some embodiments, the adjustable weight 110D can be unlocked and rotated without completely removing the fastener 140D from the threaded bore 148D. As illustrated in FIG. 11A, the fastener 140D can include a retaining member 149D configured to prevent the fastener 140D from disengaging the internally threaded bore 148D. The retaining member 149D can include an enlarged portion at the end of the fastener 140D configured to not pass through the threaded bore 148D. In another embodiment, the retaining member 149D can include a snap ring installed on the end of the fastener 140D. In some embodiments, the threaded bore 148D can be formed through a receiving nut 180D. The receiving nut 180D can be affixed to the sole 14 of the golf club head 1. The receiving nut 180D can be located in club head interior 30 opposite the adjustable weight 110D.

Figure 13A:
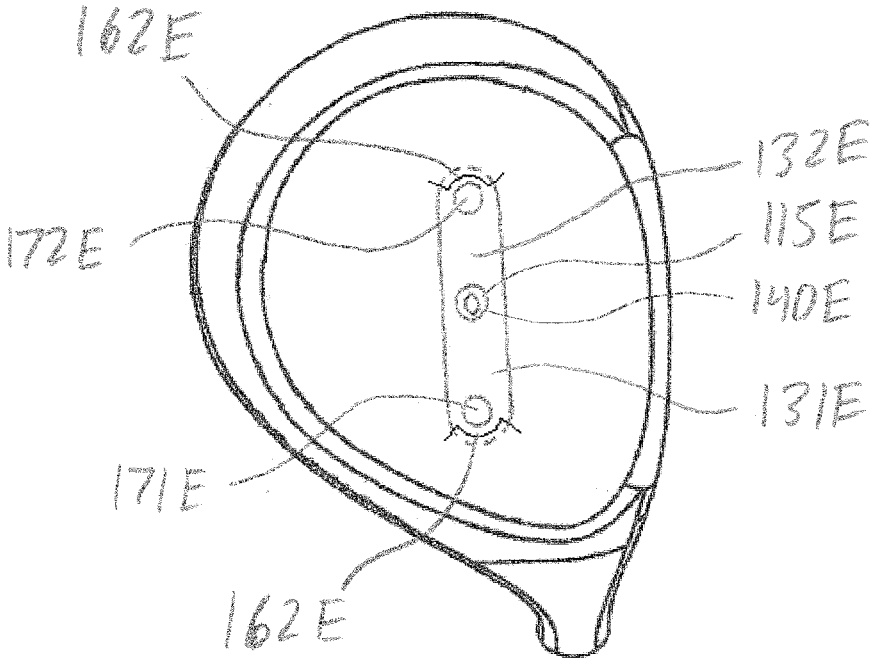
FIG. 13A illustrates a bottom view of one embodiment of a golf club head including a weight system configured to adjust the center of gravity along the x-axis.
Figure 13B:
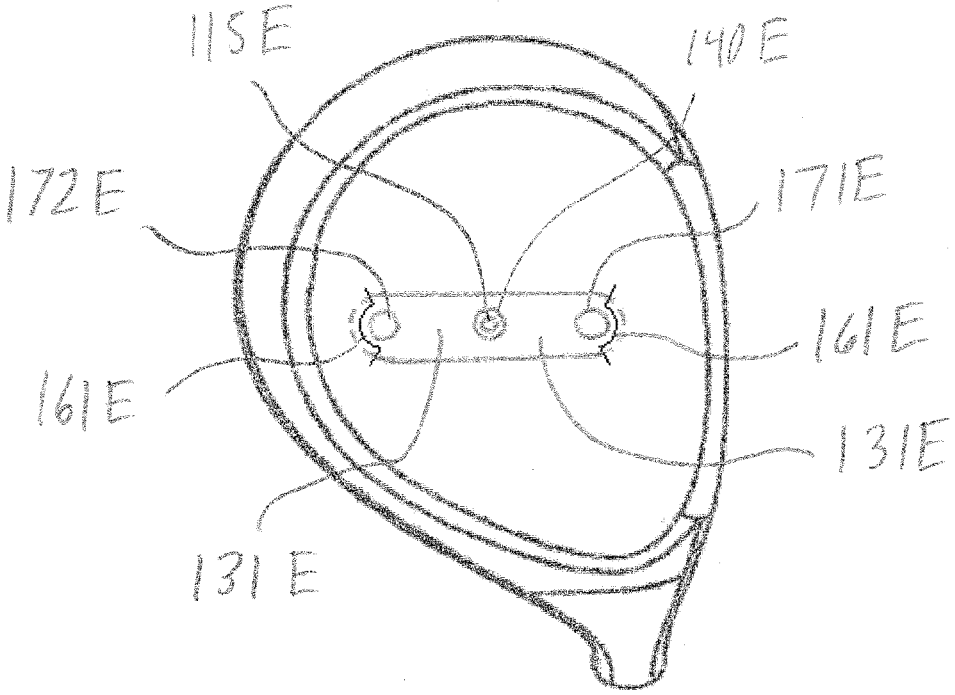
FIG. 13B illustrates a bottom view of one embodiment of a golf club head including a weight system configured to adjust the center of gravity along the z-axis.

As illustrated in FIGS. 13A and 13B, the adjustable weight 110E can include two engaging arms 131E, 132E and the sole 14 of the golf club head 1 can include two engagement members 161E, 162E. FIG. 13A illustrates a bottom view of one embodiment of a golf club head 1 including a weight system 100E configured to adjust the center of gravity along the x-axis. FIG. 13B illustrates a bottom view of one embodiment of a golf club head 1 including a weight system 100E configured to adjust the center of gravity along the z-axis.

Figure 14:
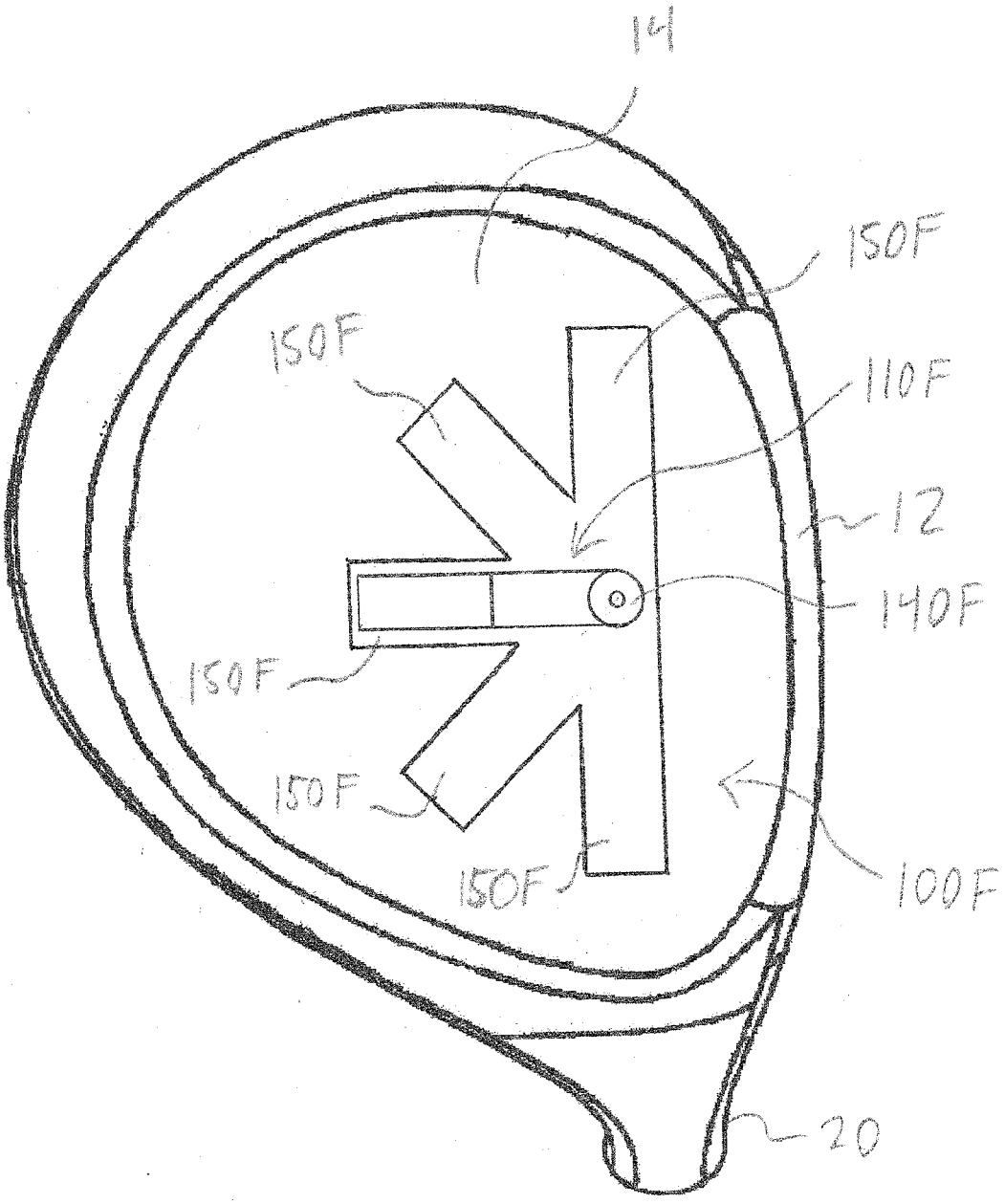
FIG. 14 illustrates a bottom view of one embodiment of a golf club head including a weight system configured to adjust the center of gravity along the x-axis and z-axis.
Figure 15:
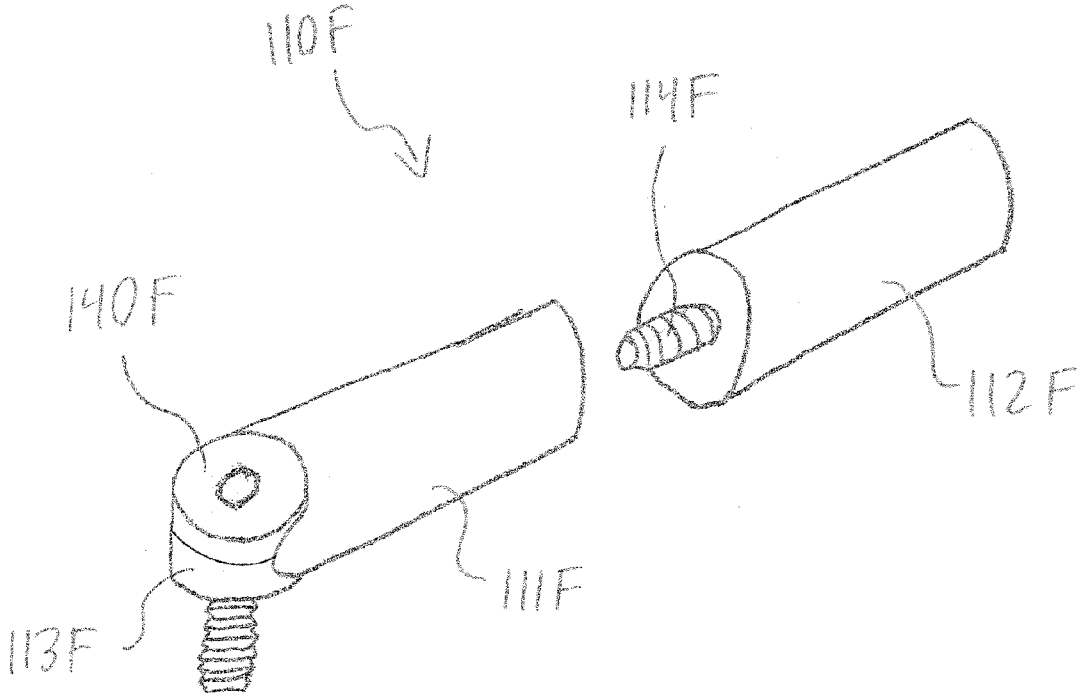
FIG. 15 illustrates a perspective view of one embodiment of the adjustable weight of the weight system of FIG. 14.
Figure 16:
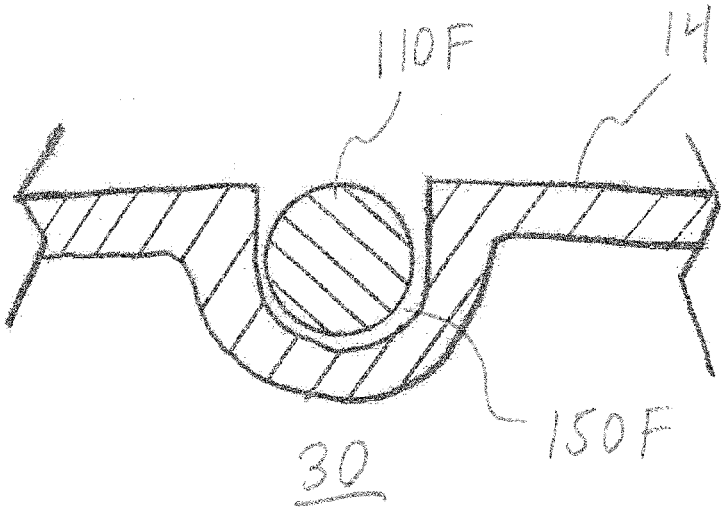
FIG. 16 illustrates a cross sectional view of the weight system of FIG. 14.

FIG. 14 illustrates a bottom view of one embodiment of a golf club head 1 including a weight system 100F configured to adjust the center of gravity along the x-axis and z-axis. FIG. 15 illustrates a perspective view of one embodiment of the adjustable weight 110F of the weight system 100F of FIG. 14. FIG. 16 illustrates a cross sectional view of the weight system 100F of FIG. 14. The adjustable weight 110F system can include a variety of positions for a rotatable adjustable weight 110F. The adjustable weight 110F can include a base 113F including an aperture 115D adapted to receive a fastener 140F. The fastener 140F can be used to affix the adjustable weight 110F to the base 113F of sole 14 of a golf club head 1. The base 113F can be located at a first end of the adjustable weight 110F such that the adjustable weight 110F can rotate about the fastener 140F when the adjustable weight 110F is in an unlocked position. The sole 14 of the golf club head 1 can include a threaded bore configured to receive the fastener 140F. The sole 14 of the golf club head 1 can include a plurality of weight channels 150F, each of which adapted to selectively receive the adjustable weight 110F. Each weight channel 150F can extend outwards away from the threaded bore. The c.g. location of the golf club head 1 can be manipulated by rotating the fastener 140F in a second direction, unlocking the adjustable weight 110F, rotating the adjustable weight 110F to the preferred weight channel 150F, and rotating the fastener 140F in a first direction, and locking the adjustable weight 110F. The fastener 140F can lock the adjustable weight 110F within the preferred weight channel 150F and the walls of the weight channel 150F can prevent the adjustable weight 110F from rotating. In some embodiments, the golf club head 1 can include two, three, four, five, six, seven, eight, nine, or more weight channels 150.

The adjustable weight 110F can include a plurality of members 111F, 112F. Each member 111F, 112F can have a different weight. Each member 111F, 112F can comprise a different material with a different density. The adjustable weight 110 can include two members 111F, 112F. In some embodiments, the first member 111F can be affixed to the base 113F of the adjustable weight 110F. The second member 112F can be adapted to engage the end of the first member 111F opposite the base 113F. The first or second member 111F, 112F can be swapped for members of different weights to further adjust the c.g. location of the golf club head 1. In some embodiments, the first member 111F can include a threaded member receiving bore and the second member 112F can include a threaded member 114F configured to engage the threaded member receiving bore. In other embodiments, other affixation methods are contemplated. In addition, the adjustable weight 110F can comprise other shapes than the circular cross section illustrated in FIGS. 15 and 16, which may include for example, an oval, a rectangle, an organic shape, etc.

Several of the embodiments described herein include a fastener. While many of the illustrated embodiments disclose a threaded fastener and threaded bore, other forms of fasteners are contemplated, including for example, rivets, pins, quick release members, etc.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head, comprising:

a body having a face, a sole, a crown, and a skirt joining said face, sole, and crown, the body having a center of gravity;

wherein said body comprises a coordinate system with an x-axis located horizontal to said face, a y-axis located vertical to said face, and a z-axis located through said face; and a weight system configured to adjust the location of said center of gravity of said body;

wherein said weight system comprises:

an adjustable weight comprising an aperture, said aperture dimensioned to receive a fastener;

a threaded bore formed in said sole, said threaded bore configured to receive a fastener; and a fastener configured to pass through said aperture of said adjustable weight and engage said threaded bore, wherein rotation of said fastener in a first direction locks said adjustable weight into a locked position, preventing said adjustable weight from rotating relative to said body;

wherein rotation of said fastener in a second direction, opposite said first direction, unlocks said adjustable weight into an unlocked position and allows said adjustable weight to rotate about said fastener, wherein said adjustable weight can be unlocked and rotated without completely removing said fastener from said threaded bore;

wherein rotation of said adjustable weight alters said location of said center of gravity of said body;

wherein said adjustable weight comprises a first engaging arm and a second engaging arm, each engaging arm comprising a proximal portion and a distal portion, said proximal portions adjacent said aperture, said engaging arms extending outwards from said aperture substantially along said sole of said body, terminating at said distal portions of said engaging arms;

wherein said first engaging arm comprises a first weight portion and said second engaging arm comprises a second weight portion, wherein said first weight portion comprises a different mass than said second weight portion;

wherein said first weight portion is affixed to said distal portion of said first engaging arm and said second weight portion is affixed to said distal portion of said second engaging arm;

wherein said sole of said golf club head comprises a first engagement member and a second engagement member, said first and second engagement members adapted to engage any one of said engaging arms when said adjustable weight is in said locked position, said first and second engagement members preventing said adjustable weight from rotating relative to said body;

wherein said first and second engagement members comprise recesses formed in said sole of said body dimensioned to receive said distal portions of said engaging arms;

wherein said rotation of said fastener in said first direction forces said proximal portions of said engaging arms to move towards said sole, said engaging arms to deflect, and said distal portions of said engaging arms to extend outwards away from said fastener, substantially parallel to said sole of said body, and, provided said engaging arms are aligned with said engagement members, said rotation of said fastener in said first direction forces said distal portions of said engaging arms to protrude into said recesses of said engagement members, and wherein said rotation of said fastener in said second direction allows said proximal portions of said engaging arms to extend away from said sole and said distal portions of said adjustable weight to retract inwards towards said fastener, substantially parallel to said sole of said body, disengaging said engaging arms from said engagement members.

2. The golf club head of claim 1, wherein said fastener includes a retaining member configured to prevent said fastener from disengaging said internally threaded bore.

3. The golf club head of claim 1, wherein said adjustable weight comprises a third engaging arm, a third weight portion, and a third engagement member.

4. A golf club head comprising:

a body having a face, a sole, a crown, and a skirt joining said face, sole, and crown, the body having a center of gravity;

wherein said body comprises a coordinate system with an x-axis located horizontal to said face, a y-axis located vertical to said face, and a z-axis located through said face; and a weight system configured to adjust the location of said center of gravity of said body;

wherein said weight system comprises:

an adjustable weight; and a fastener configured to engage said adjustable weight, wherein rotation of said fastener in a first direction locks said adjustable weight in a locked position;

wherein rotation of said fastener in a second direction, opposite said first direction, unlocks said adjustable weight into an unlocked position and allows said adjustable weight to be moved, wherein said adjustable weight can be unlocked and moved without removing said fastener;

wherein movement of said adjustable weight alters said location of said center of gravity of said body;

further comprising a channel formed therein said sole of said body, wherein said channel is dimensioned to slideably receive said adjustable weight;

wherein said adjustable weight comprises a first member and a second member, said first member comprising a first weight body, said first weight body of said first member comprising a bore formed therein to receive a fastener, said second member comprising a second weight body, said second weight body of said second member comprising an internally threaded bore to engage said fastener, wherein rotation of said fastener in a first direction forces said first member closer to said second member and wherein rotation of said fastener in a second direction, opposite said first direction, allows said first member to extend away from said second member;

wherein said channel comprises a first wall and a second wall substantially parallel to said first wall, wherein said first weight body of said first member is adjacent said first wall and said second weight body of said second member is adjacent said second wall, wherein said first member comprises at least two engaging arms extending away from said first weight body of said first member and towards said second wall and wherein said second member comprises at least two engaging arms extending away from said second weight body of said second member and towards said first wall.

5. The golf club head of claim 4, wherein when said fastener is rotated in a first direction, said engaging arms of said first member are configured to contact said second wall and deflect and said engaging arms of said second member are configured to contact said first wall and deflect.

6. The golf club head of claim 5, wherein said engaging arms engaging said first and second walls prevent said adjustable weight from sliding along said channel when said adjustable weight is in a locked position.

7. The golf club head of claim 6, wherein at least one of said engaging arms includes at least one protrusion and wherein at least one of said first and second walls include a corresponding recess configured to receive said at least one protrusion, wherein said at least one protrusion and at least one recess are configured to prevent said adjustable weight from sliding along said channel when said adjustable weight is in a locked position.

8. The golf club head of claim 7, wherein said first wall and said second wall are substantially perpendicular to said y axis, wherein said first wall comprises an access port to access said adjustable weight.

* * * * *